US010598453B2

(12) United States Patent
Underwood et al.

(10) Patent No.: US 10,598,453 B2
(45) Date of Patent: Mar. 24, 2020

(54) FIREARM LOADER

(71) Applicant: MEAN LLC, Woodstock, GA (US)

(72) Inventors: James Matthew Underwood, Kennesaw, GA (US); Larry Cullen Underwood, Canton, GA (US)

( * ) Notice: Subject to any disclaimer, the term of this patent is extended or adjusted under 35 U.S.C. 154(b) by 0 days.

(21) Appl. No.: 15/845,209

(22) Filed: Dec. 18, 2017

(65) Prior Publication Data

US 2018/0172378 A1 Jun. 21, 2018

Related U.S. Application Data

(60) Provisional application No. 62/435,535, filed on Dec. 16, 2016, provisional application No. 62/467,389, filed on Mar. 6, 2017, provisional application No. 62/564,635, filed on Sep. 28, 2017.

(51) Int. Cl.

| | |
|---|---|
| ***F41A 9/83*** | (2006.01) |
| ***F41A 9/70*** | (2006.01) |
| ***F41A 9/67*** | (2006.01) |

(52) U.S. Cl.

CPC *F41A 9/70* (2013.01); *F41A 9/67* (2013.01); *F41A 9/83* (2013.01)

(58) Field of Classification Search

CPC ..... F41A 9/82; F41A 9/83; F41A 9/84

USPC ..... 42/87, 88

See application file for complete search history.

(56) References Cited

U.S. PATENT DOCUMENTS

| | | | | | |
|---|---|---|---|---|---|
| 211,691 | A | * | 1/1879 | Bennett | F41A 9/83 42/87 |
| 356,276 | A | * | 1/1887 | Diss | F41A 9/84 42/88 |
| 391,811 | A | * | 10/1888 | Mixter | F41A 9/83 42/87 |
| 402,605 | A | | 5/1889 | Mauser | |
| 676,371 | A | * | 6/1901 | Scott | F41A 9/84 42/88 |
| 677,203 | A | * | 6/1901 | Gibson | F41A 9/84 42/88 |
| 871,355 | A | * | 11/1907 | Morlan | F41A 9/72 42/87 |
| 1,732,949 | A | * | 10/1929 | Pedersen | F41A 9/84 42/88 |
| 2,017,988 | A | * | 10/1935 | Pedersen | F41A 9/84 42/87 |
| 2,081,235 | A | | 5/1937 | Hillyard | |
| 2,403,012 | A | * | 7/1946 | McPheters | F41A 9/83 42/87 |
| 2,783,570 | A | * | 3/1957 | Kunz | F41A 9/66 42/18 |

(Continued)

FOREIGN PATENT DOCUMENTS

| | | | |
|---|---|---|---|
| CH | 669253 | A5 | 2/1989 |
| EP | 0205661 | A2 | 12/1986 |

(Continued)

*Primary Examiner* — Jonathan C Weber

(57) ABSTRACT

A firearm loader may be used to transfer at least one cartridge to a firearm. The loader includes a main body comprising a proximal end and a distal end and a follower disposed inside the main body. The loader may include an engaged configuration wherein the loader is at least partially inserted into a firearm. The proximal end may include an opening. In the engaged configuration, the opening approximately faces a magazine of the firearm.

20 Claims, 25 Drawing Sheets

(56) References Cited

U.S. PATENT DOCUMENTS

| | | | | | |
|---|---|---|---|---|---|
| 2,834,137 | A | * | 5/1958 | Kunz | F41A 9/83 42/87 |
| 2,856,720 | A | * | 10/1958 | Kunz | F41A 9/84 42/87 |
| 2,887,811 | A | * | 5/1959 | Johnson, Jr. | F41A 9/84 42/87 |
| 2,894,350 | A | * | 7/1959 | Janson | F41A 9/84 42/50 |
| 4,509,284 | A | * | 4/1985 | Naber | F41A 9/83 42/87 |
| 4,614,052 | A | | 9/1986 | Brown et al. | |
| 4,756,110 | A | * | 7/1988 | Beltron | F41A 9/83 42/87 |
| 4,862,621 | A | * | 9/1989 | Kearney | F41A 9/83 42/87 |
| 5,402,594 | A | | 4/1995 | Switzer | |
| 6,754,987 | B1 | | 6/2004 | Cheng | |
| 9,273,917 | B1 | | 3/2016 | Buckner | |
| 9,279,631 | B2 | | 3/2016 | Barnhart | |
| 9,335,108 | B2 | | 5/2016 | Cauley, Jr. et al. | |
| D790,030 | S | * | 6/2017 | Ulbrich | F41A 9/84 D22/108 |
| D799,632 | S | * | 10/2017 | Ulbrich | F41A 9/84 D22/108 |
| 9,939,219 | B1 | * | 4/2018 | Ulbrich | F41C 7/00 |
| 9,989,324 | B1 | | 6/2018 | Ulbrich et al. | |
| 10,190,836 | B2 | | 1/2019 | Ulbrich et al. | |
| 2009/0044440 | A1 | | 2/2009 | Tal et al. | |
| 2012/0192477 | A1 | | 8/2012 | Kim | |
| 2014/0298704 | A1 | | 10/2014 | Niccum | |
| 2015/0198395 | A1 | | 7/2015 | Visinski et al. | |

FOREIGN PATENT DOCUMENTS

| | | | | | |
|---|---|---|---|---|---|
| GB | 191516759 | A | * | 11/1916 | F41A 9/84 |
| GB | 1058333 | | | 2/1967 | |

* cited by examiner

FIREARM LOADER

CROSS REFERENCE TO RELATED APPLICATIONS

This application is related to and claims priority benefit from U.S. Provisional Application No. 62/435,535 ("the '535 application"), filed on Dec. 16, 2016; U.S. Provisional Application No. 62/467,389 ("the '389 application"), filed on Mar. 6, 2017; and U.S. Provisional Application No. 62/564,635 ("the '635 application"), filed on Sep. 28, 2017. The '535 application, the '389 application, and the '635 application are hereby incorporated in their entireties by this reference.

FIELD OF THE INVENTION

The field of the invention relates to firearms, particularly methods and devices for loading at least one round of ammunition into a firearm.

BACKGROUND

Since the advent and standardization of self-contained metallic cartridge ammunition, firearms have included systems and devices for loading and/or storing ammunition. Many modern firearms (including handguns, rifles, carbines, shotguns, etc.) include a magazine for storing ammunition. Magazines may be integral/fixed to the firearm or may be detachable. Different magazine arrangements include tube, box, rotary, drum, casket, pan, helical, saddle-drum, or various other arrangements.

Some anti-firearm laws, such as those enacted in California, ban the sale of many semi-automatic, centerfire rifles or semi-automatic pistols that do not have a fixed magazine. To facilitate loading of fixed magazine firearms, it may be desirable to find alternative devices and methods for loading ammunition that does not include a removable magazine. In addition, in some cases, loading devices may enable faster and more efficient loading of firearms with removable magazines.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a firearm loader for transferring at least one cartridge to a firearm comprises: a main body comprising a proximal end and a distal end; and a follower disposed inside the main body, wherein: the loader comprises an engaged configuration wherein the loader is at least partially inserted into a firearm; the proximal end comprises an opening; and in the engaged configuration, the opening approximately faces a magazine of the firearm.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Although the illustrated embodiments shown in FIGS. 1A-22B illustrate components of various semi-automatic or automatic rifles, the features, concepts, and functions described herein are also applicable (with potential necessary alterations for particular applications) to handguns, rifles, carbines, shotguns, or any other type of firearm. Furthermore, the embodiments may be compatible with various calibers including rifle calibers such as, for example, 5.56×45 mm NATO, .223 Remington, 7.62×51 mm NATO, .308 Winchester, 7.62×39 mm, 5.45×39 mm; handgun calibers such as, for example, 9×19 mm, .45 ACP, .40 S&W, .380 ACP; and shotgun calibers such as, for example, 12 gauge, 20 gauge, 28 gauge, .410 gauge, 10 gauge, 16 gauge.

Figure 1A:
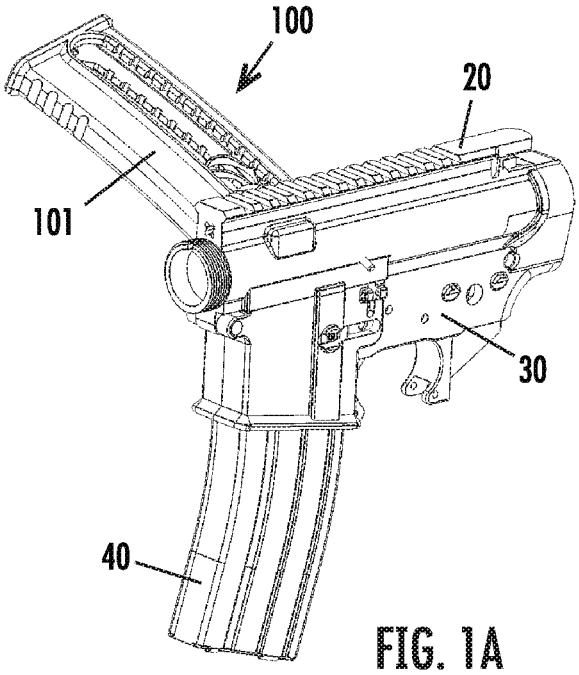
FIG. 1A is an front left partial perspective view of a firearm, according to certain embodiments of the present invention.
Figure 1B:
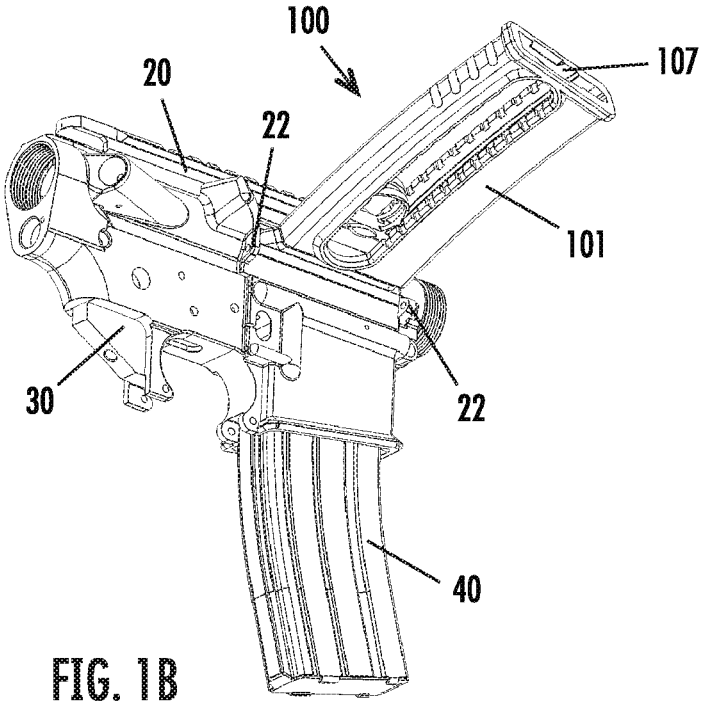
FIG. 1B is a rear right partial perspective view of the firearm of FIG. 1A.
Figure 1C:
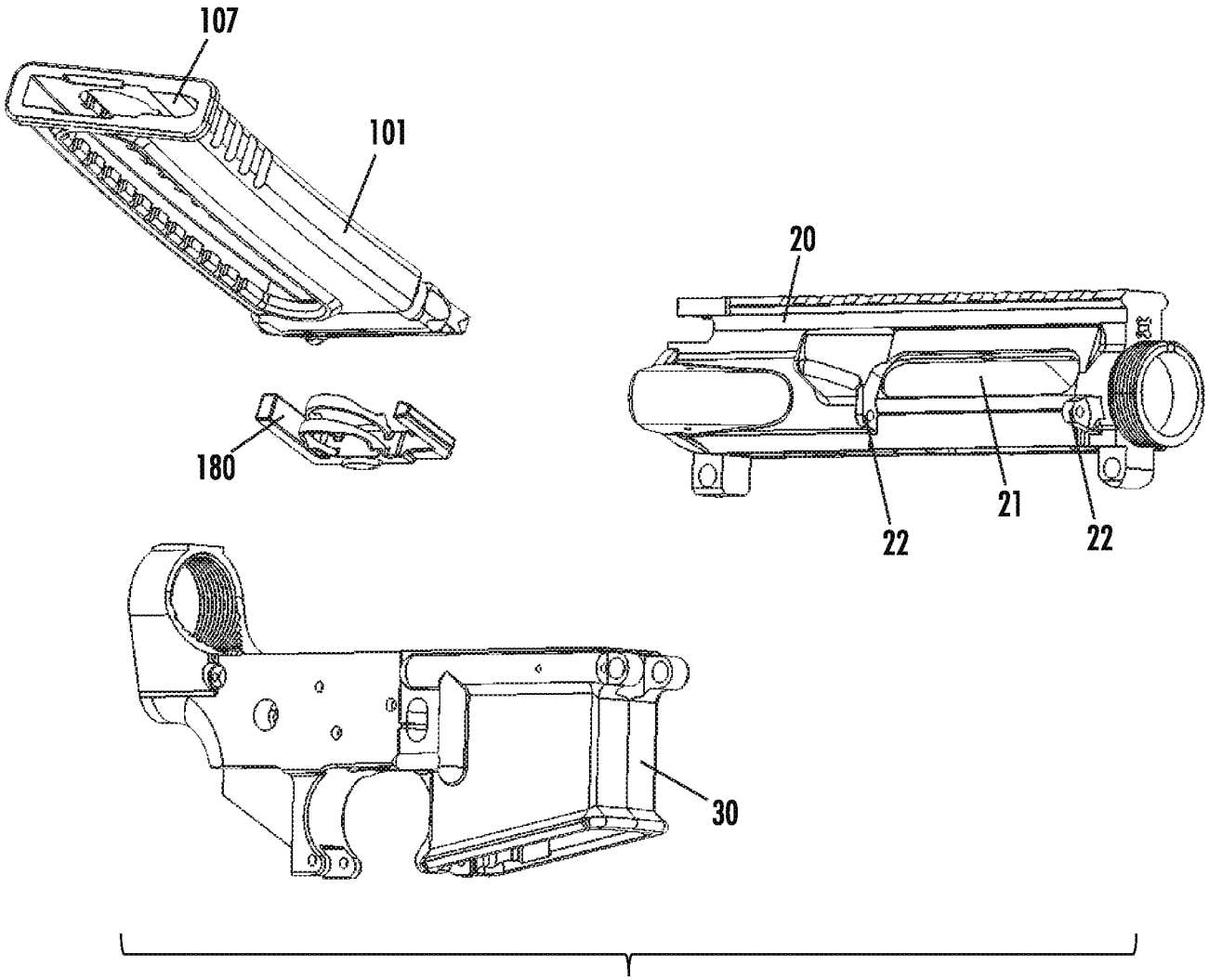
FIG. 1C is a front right partial perspective exploded view of the firearm of FIG. 1A.

According to certain embodiments of the present invention, as shown in FIGS. 1A-1C, a loader 100 may interface with a receiver of a firearm. The loader 100 may be a portable device capable of being inserted into and removed from a firearm (e.g., into an ejection port). In some embodiments, the loader 100 is inserted into the ejection port 21 (see FIG. 1C) of the upper receiver 20 of a firearm. The loader 100 facilitates the loading of at least one round of ammunition through the ejection port 21, through the upper receiver 20, through the lower receiver 30, and into the magazine 40. The loader 100 may facilitate loading of 5 rounds, 10 rounds, 20 rounds, 30 rounds, 40 rounds, or any other appropriate number of rounds. In some embodiments, magazine 40 is fixed in position. As shown in FIG. 1C, the loader 100 includes a follower 180.

Figure 2:
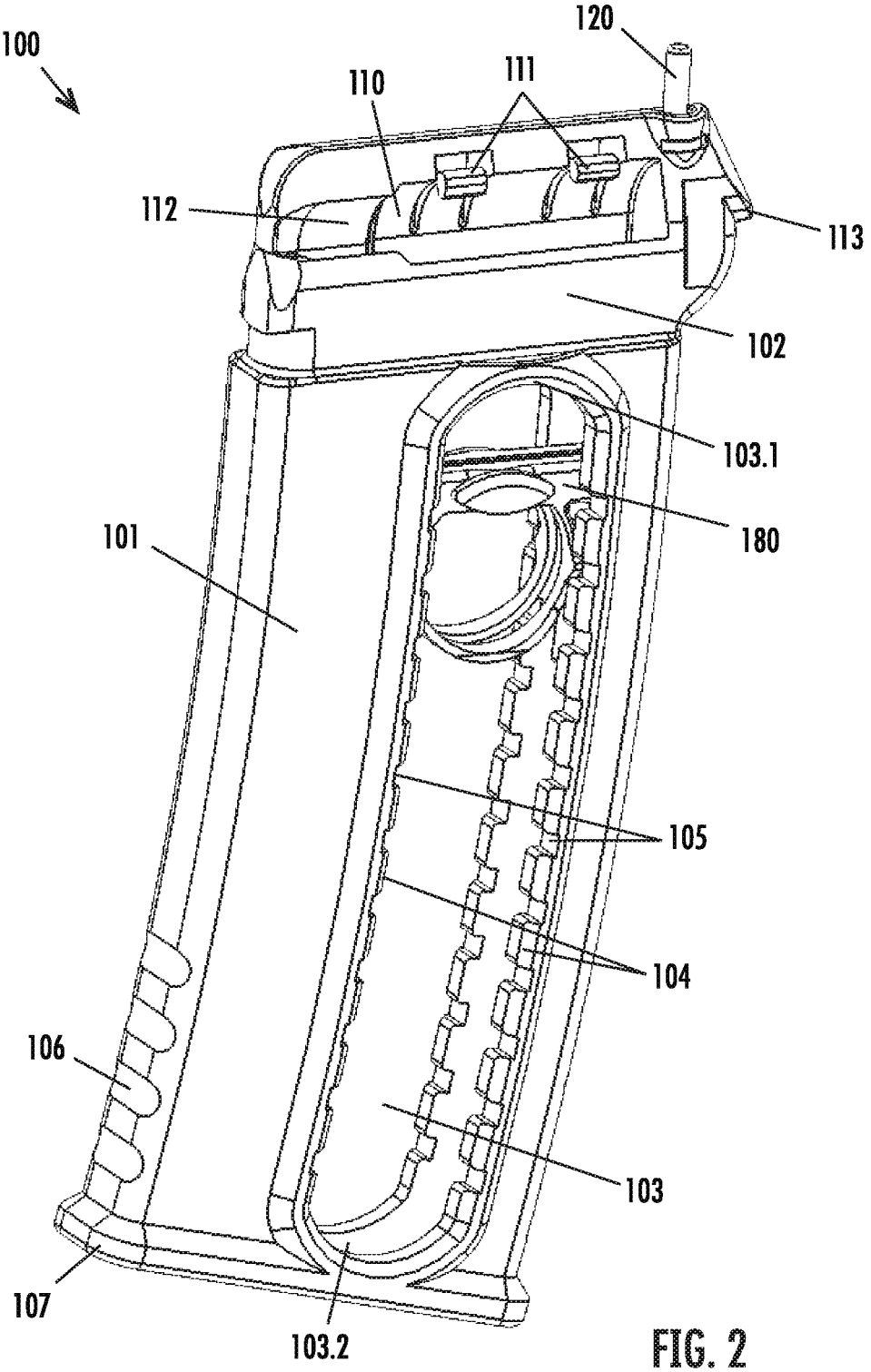
FIG. 2 is a bottom perspective view of a loader, according to certain embodiments of the present invention.
Figure 3:
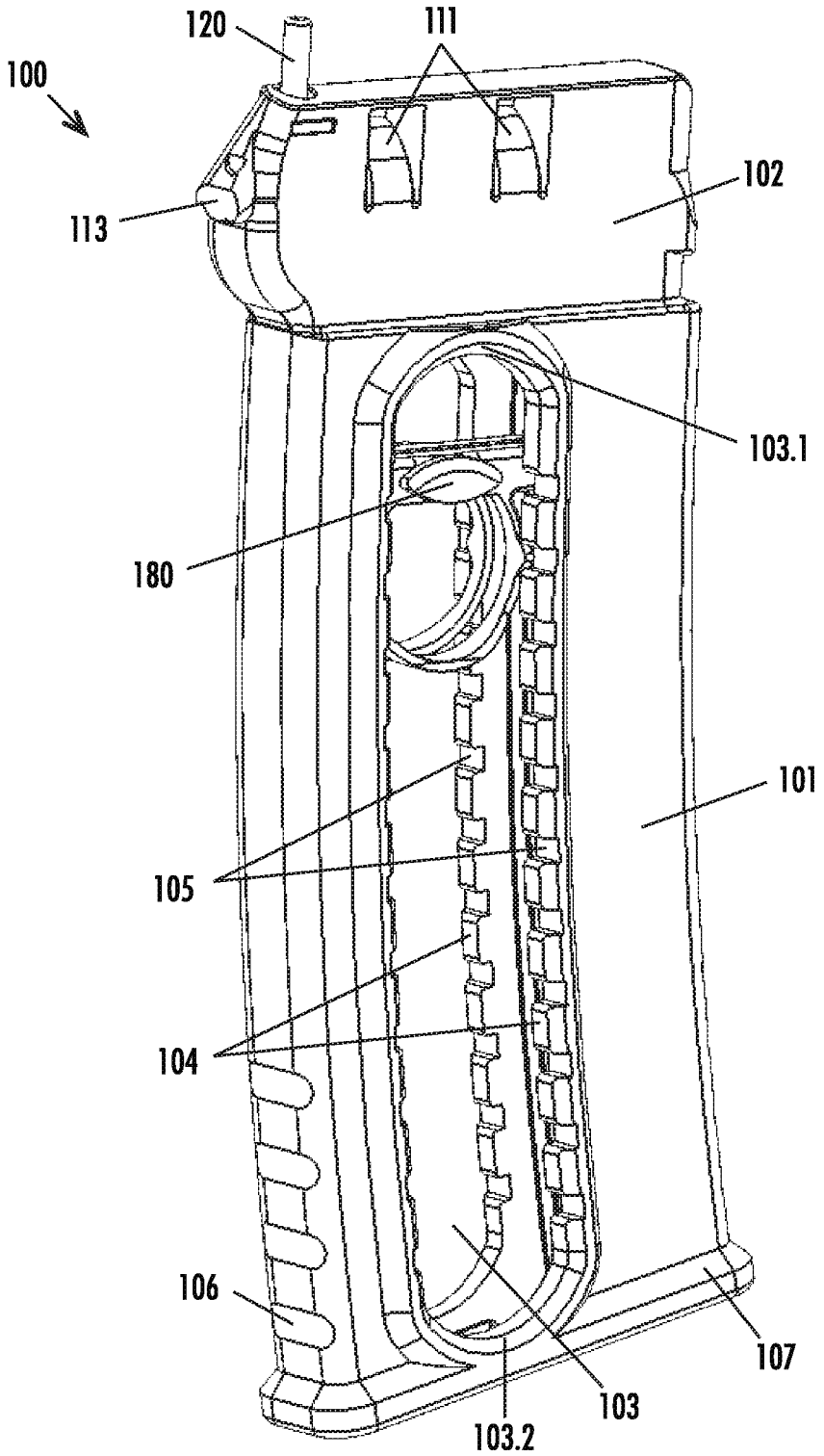
FIG. 3 is a top perspective view of the loader of FIG. 2.

In some embodiments, as shown in FIGS. 2 and 3, the loader 100 includes a main body 101, a proximal end 102, and a distal end 107 where the proximal end 102 may be inserted into the firearm. The main body 101 may include a channel 103 that extends at least partially through the thickness of the main body 101. The channel 103 may extend along at least part of the length of the main body 101. Near the distal end 107, the loader 100 may include grip features 106 such as serrations, checkering, stippling, or any other appropriate feature for enhancing grip.

Figure 10:
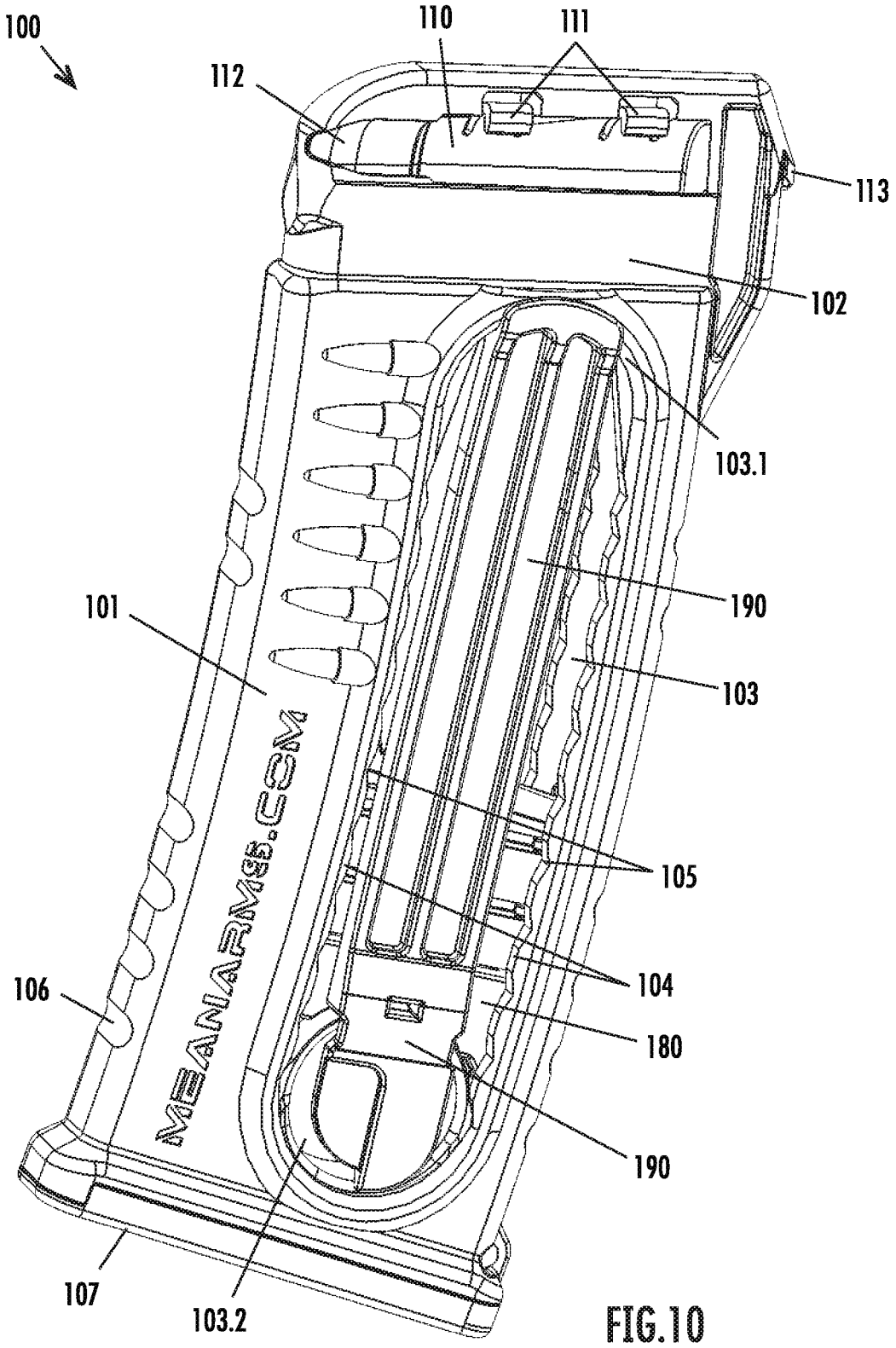
FIG. 10 is a bottom perspective view of a loader, according to certain embodiments of the present invention.
Figure 11:
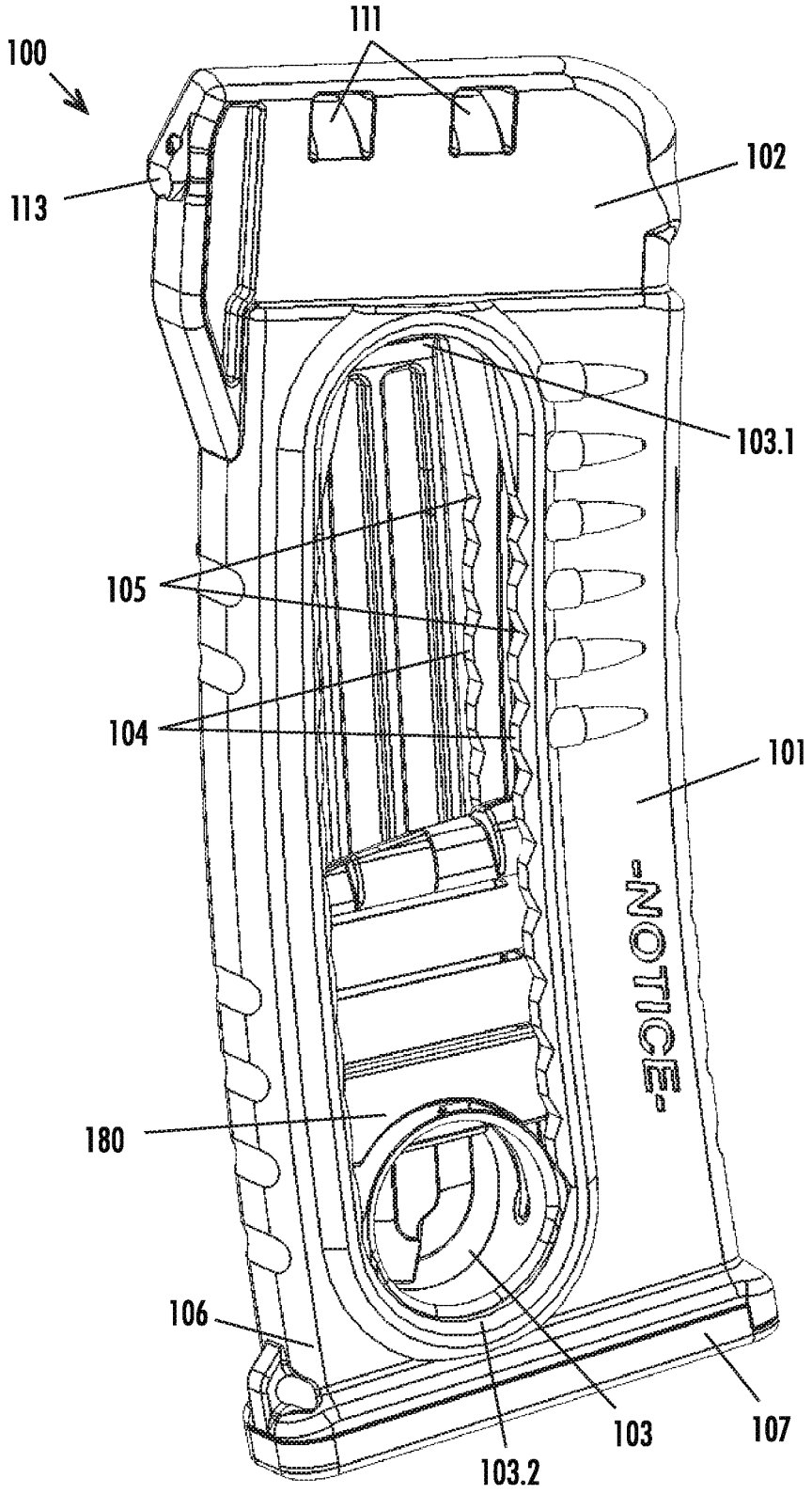
FIG. 11 is a top perspective view of the loader of FIG. 10.

At the proximal end 102, there is an opening 110 to allow cartridges to move from the loader 100 into the firearm (see FIGS. 2 and 10). The opening 110 may include at least one spring 111, which prevent cartridges from falling through the opening 110. To insert a cartridge into the loader 100, the cartridge may be pressed into the opening 110 causing the spring(s) 111 to move away from the opening 110. As shown in FIGS. 2 and 10, the opening 110 may include a profiled shape including a narrower portion 112 that approximately corresponds to the shape of the projectile end of a cartridge such that cartridges can only be inserted into the loader in one orientation. The spring(s) 111 also prevent cartridge(s) from exiting the loader 100 unless the follower 180 is pushed toward the proximal end 102 (causing the spring(s) 111 to deflect away from the opening 110). In addition, spring(s) 111 guide cartridge(s) into the firearm.

To use the loader 100, the operator of the firearm/loader pushes cartridges into the opening 110 with the projectile end of the cartridge aligned with the narrower portion 112 of the opening 110. As explained above, the cartridge will not pass through the opening 110 unless the operator presses the cartridge to deflect the spring(s) 111 away from the opening 110. When one or more cartridges are inside the loader 100, the cartridges press the follower 180 toward the distal end 103.2 of the opening 130. In some embodiments, cartridges press against a spacer 251 to move the follower 180 away from the opening 110.

In some embodiments, the loader 100 has an engaged configuration and a disengaged configuration. For example, the engaged configuration occurs when the loader 100 is inserted into the upper receiver 20 (as shown in FIGS. 1A and 1B) such that the opening 110 faces downward approximately toward the lower receiver 30 and the magazine 40. To insert the loader 100 into the upper receiver 20, the bolt (not shown) must be held open (e.g., after the last round in the magazine is fired, the bolt is held open) such that the ejection port 21 is open. When the proximal end 102 of the loader 100 is fully inserted into the upper receiver 20, the protrusion 113 (on the rear side of the proximal end 102) engages the face of the bolt. In addition, when the loader 100 is inserted into the upper receiver 20, the spring-loaded plunger 120 is compressed against an internal surface of the firearm. In particular, the spring-loaded plunger 120 may be pressed against the inner surface of the upper receiver 20 on the opposite side of the upper receiver 20 from the ejection port 21. Once the loader 100 is inserted into the ejection port 21 and engages the bolt face (using protrusion 113), the operator of the firearm may push the follower 180 toward the proximal end 102 (e.g., by moving/manipulating ring portion 182) to push cartridges from the loader 100 into the firearm. After all of the ammunition is transferred from the loader 100 to the firearm, the firearm operator engages the charging handle (not shown) to pull the bolt rearward (away from the protrusion 113). When the protrusion 113 is released from the bolt (due to movement of the charging handle), the spring-loaded plunger 120 pushes the loader 100 out of the upper receiver 20 such that the loader 100 is in the disengaged configuration (i.e., not inserted into the firearm).

In some embodiments, when the loader 100 is in the engaged configuration (inserted into the upper receiver 20), the loader 100 can be used to release the bolt of the firearm. In other words, the firearm may be stored with the loader 100 in the engaged configuration such that the loader holds the bolt in the open position (such that the firearm is non-operational). The loader 100 act as a chamber safe. The operator of the firearm may remove the loader 100 from the firearm to release the bolt to make the firearm operational.

As shown in FIGS. 2, 3, 10 and 11, the channel 103 includes a proximal end 103.1 and a distal end 103.2. The channel 103 may extend through a full thickness of the body 101 (as shown) or may extend partially through the thickness of the body 101 (i.e., one side of body 101 may include a solid wall such that channel 103 extends through half of the body 101). In some embodiments, the channel 103 may include a partial cover. One or more of the edges of the channel 103 extending between the proximal end 103.1 and the distal end 103.2 may include at least one locating feature, such as a series of protrusions 104 and recesses 105. The illustrated embodiments show a total of four series of protrusions 104/recesses 105 but embodiments with one, two, or three series are also contemplated.

Figure 12:
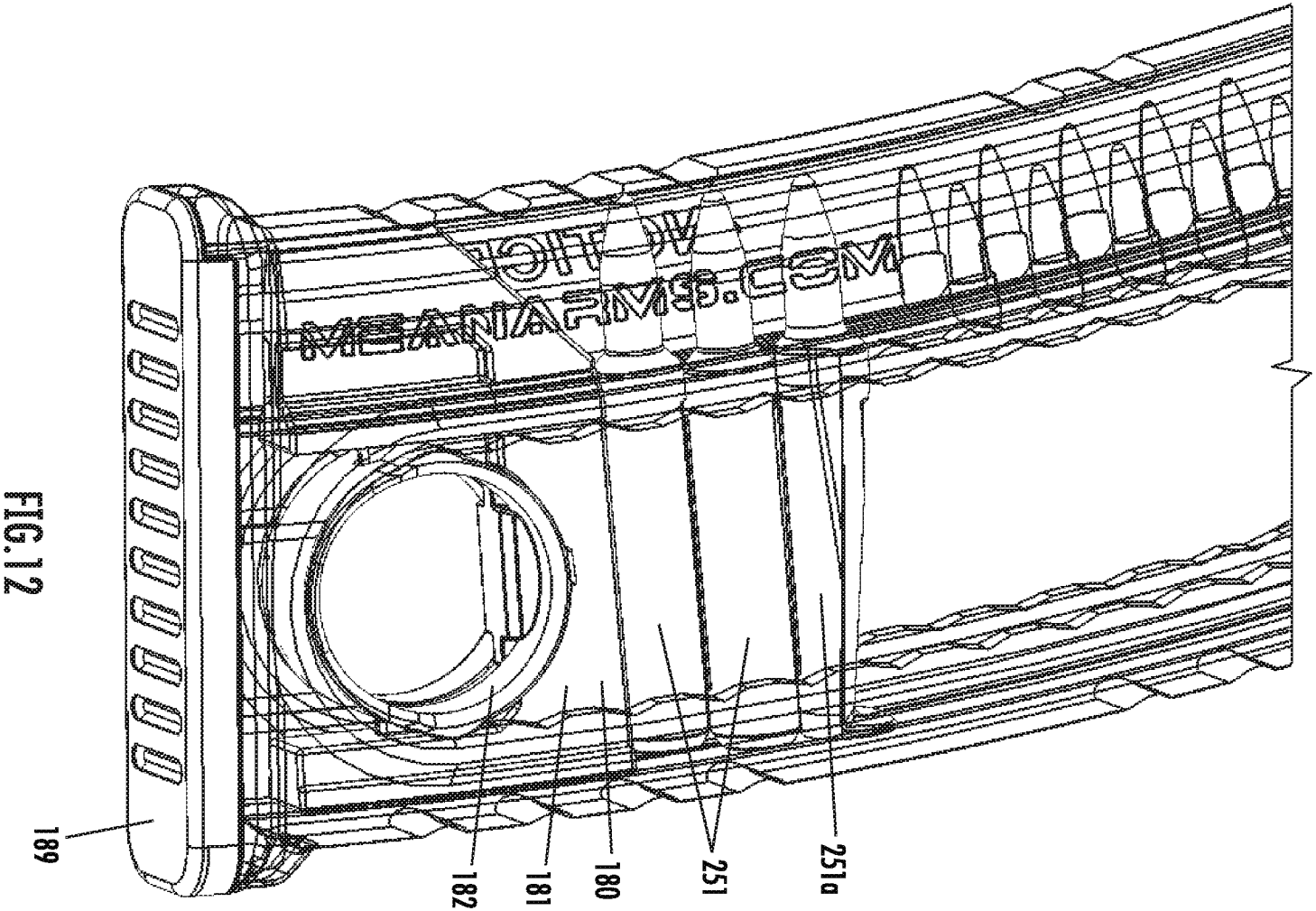
FIG. 12 is a partial perspective view of the loader of FIG. 10.
Figure 13A:
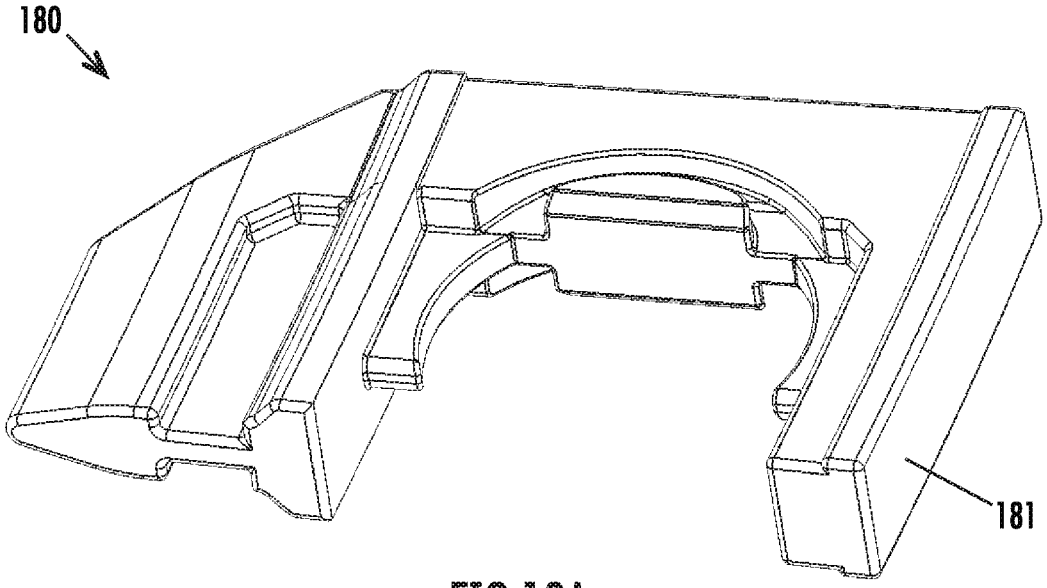
FIGS. 13A and 13B are perspective views of a follower of the loader of FIG. 10.
Figure 13B:
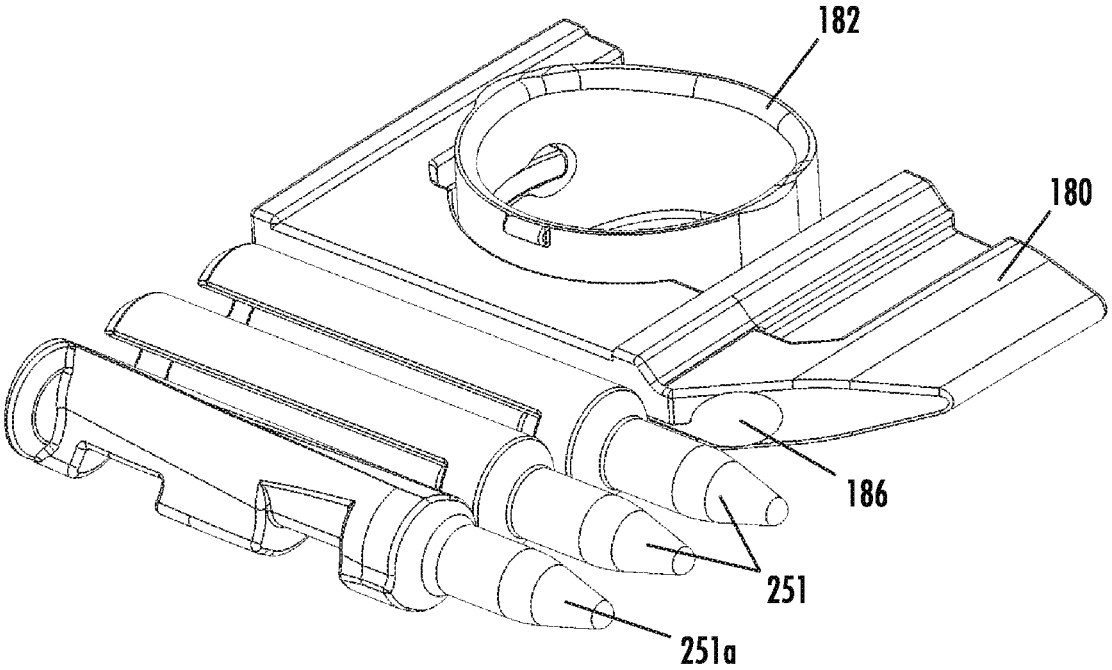

At the distal end 107, the loader 100 may have an opening which is too small for follower 180 to pass through (see FIG. 1C) or, in some embodiments, may include a removable floor plate 189 (see FIG. 12). The loader 100 may function whether or not the removable floor plate 189 is installed. In some examples, the removable floor plate 189 is available in a plurality of colors and/or patterns/designs such that multiple loaders may be distinguished from one another. The removable floor plate may also include at least one area for a label.

The follower 180 may interface with the channel 103 in one or more manners. As shown in FIGS. 6A, 6B, and 13A-14B, the follower 180 may include a U-shaped body 181, a ring portion 182, at least one protrusion 183 adjacent to a leading edge of the follower 180, and an interface channel 186. The ring portion 182, in certain embodiments, is split into two parts (first portion 182*a* and second portion 182*b*) and includes an expanded portion 184 at the trailing edge of the ring portion 182 and at least one indexing portion 185. In some embodiments, when a maximum number of cartridges are inserted into the loader 100, the follower 180 moves toward the distal end 103.2 of the channel 103 such that the expanded portion 184 of the ring portion 182 presses against the internal surface of the distal end 103.2 (to limit the travel of the follower 180). In some embodiments, the follower 180 moves toward the distal end 103.2 such that the one protrusion(s) 183 press against the internal surface of the distal end 103.2 (to limit the travel of the follower 180).

Figure 6A:
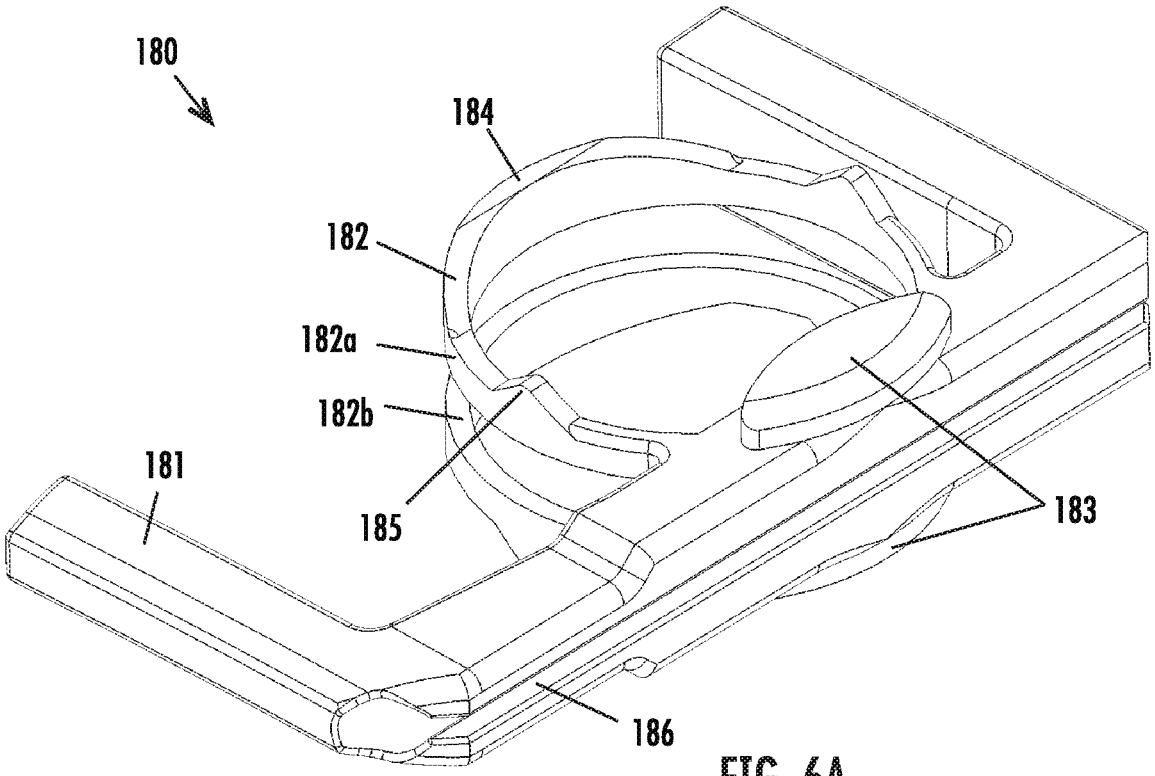
FIGS. 6A and 6B are perspective views of a follower of the loader of FIG. 2.
Figure 6B:
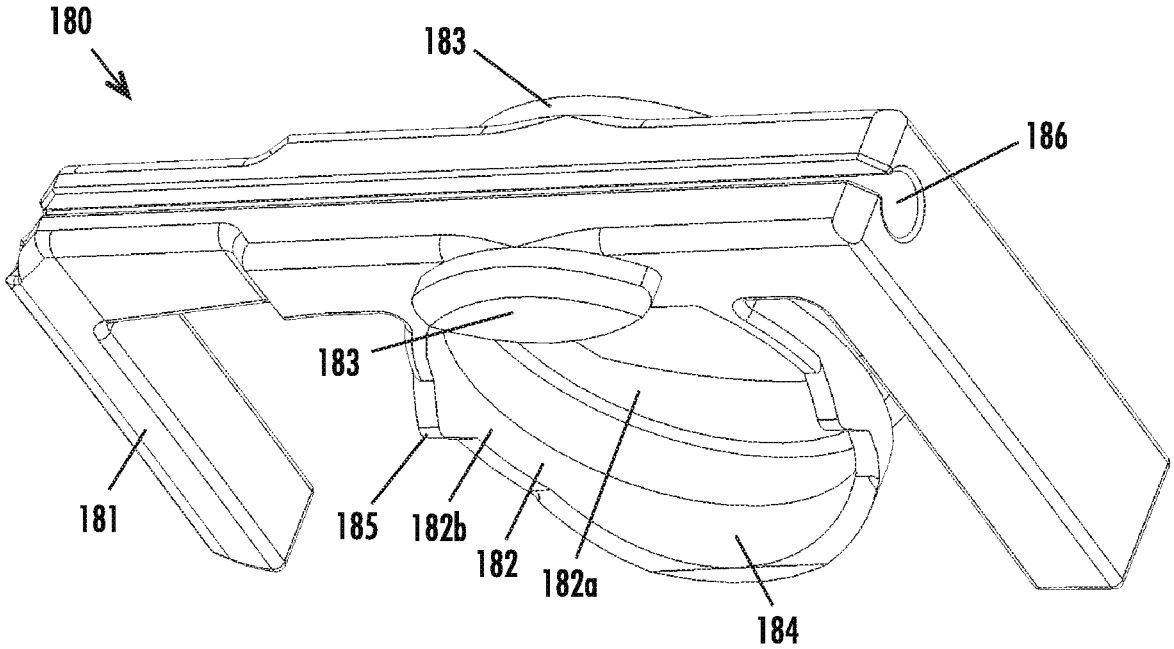
Figure 6C:
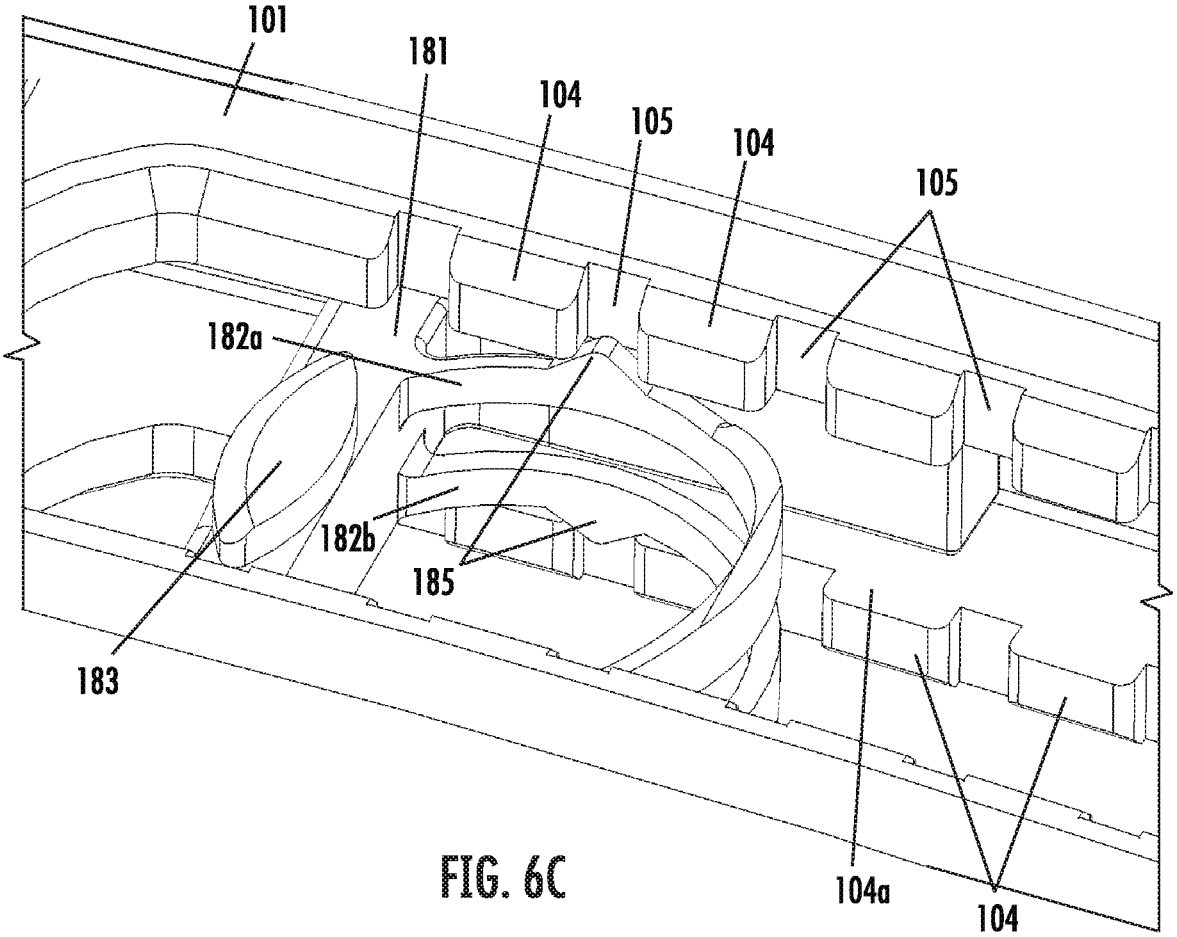
FIG. 6C is a partial perspective view of the follower of FIG. 2.

As shown in FIG. 6C, in some embodiments, the first portion 182*a* and the second portion 182*b* may each include an indexing portion 185 including a V-shaped protrusion that extends in an axial direction and is inserted into one of the recesses 105 (between two protrusions 104). To move the follower 180 along the length of the body 101, a force may be exerted against the follower 180 (by pushing/pulling the ring portion 182, pushing cartridges into the loader 100, or in some other manner). Forces applied to the follower 180 along the length of the body 101 may cause one of the inclined surfaces of the indexing portion(s) 185 to press against an adjacent protrusion 104 causing the first portion 182*a* and/or the second portion 182*b* to deflect inward (toward one another). The first portion 182*a* and the second portion 182*b* deflect toward one another until the V-shaped protrusion of each indexing portion 185 can slide across the innermost surface 104*a* of the protrusion 104. The follower 180 moves linearly along the body 101 until the indexing portion(s) 185 reach another recess 105, which causes the first portion 182*a* and the second portion 182*b* to move away from one another (acting as a spring) such that the indexing portion 185 is inserted into the recess 105. In certain embodiments, the follower 180 is not biased (e.g., by a spring) toward either end of the body 101 and is held in a given position due to an interface between recesses 105/protrusions 104 and the indexing portion(s) 185 (and/or indexing portion 185*a*, described below).

Figure 14A:
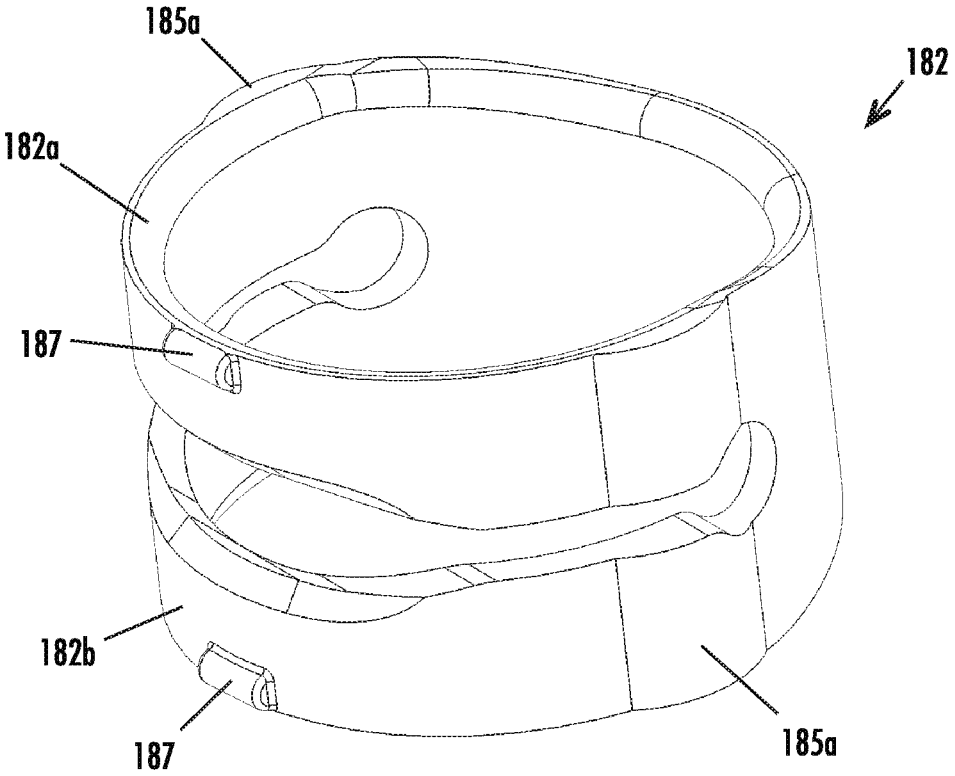
FIG. 14A is a perspective view of a ring portion of the loader of FIG. 10.
Figure 14B:
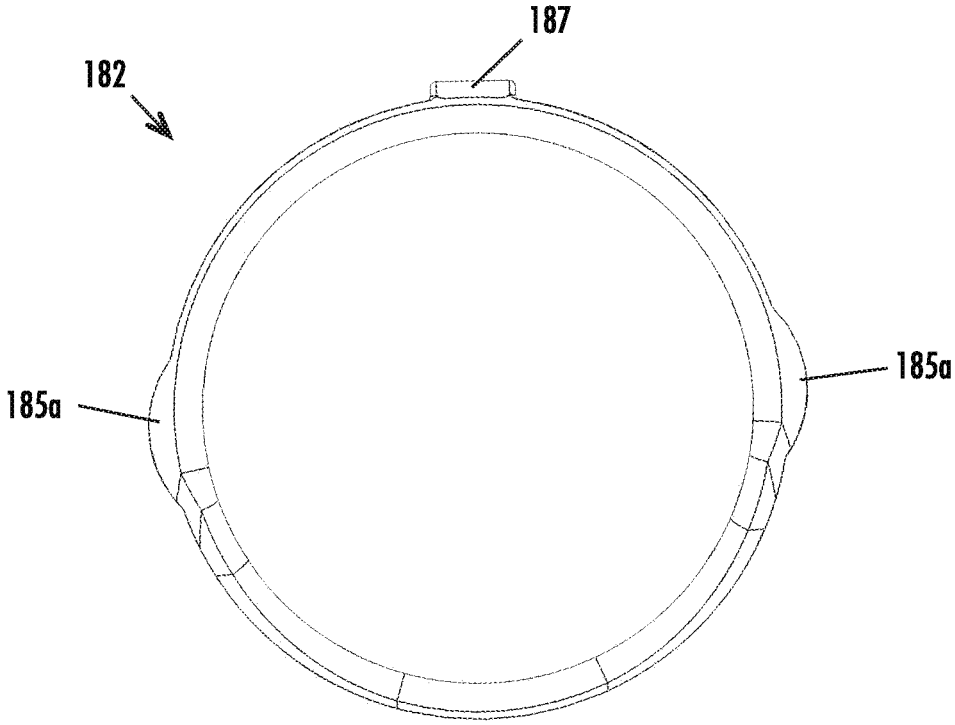
FIG. 14B is a top view of a ring portion of the loader of FIG. 10.

In some embodiments, as shown in FIGS. 10-14B, the ring portion 182 may be separable from the follower 180. As shown in FIGS. 14A and 14B, the at least one indexing portion 185*a* may extend from the ring portion 182 in a circumferential direction. The ring portion 182 may also include at least one protrusion 187, which engages a recess 196 of the tool 190 when the tool 190 is in the installed position.

Figure 16A:
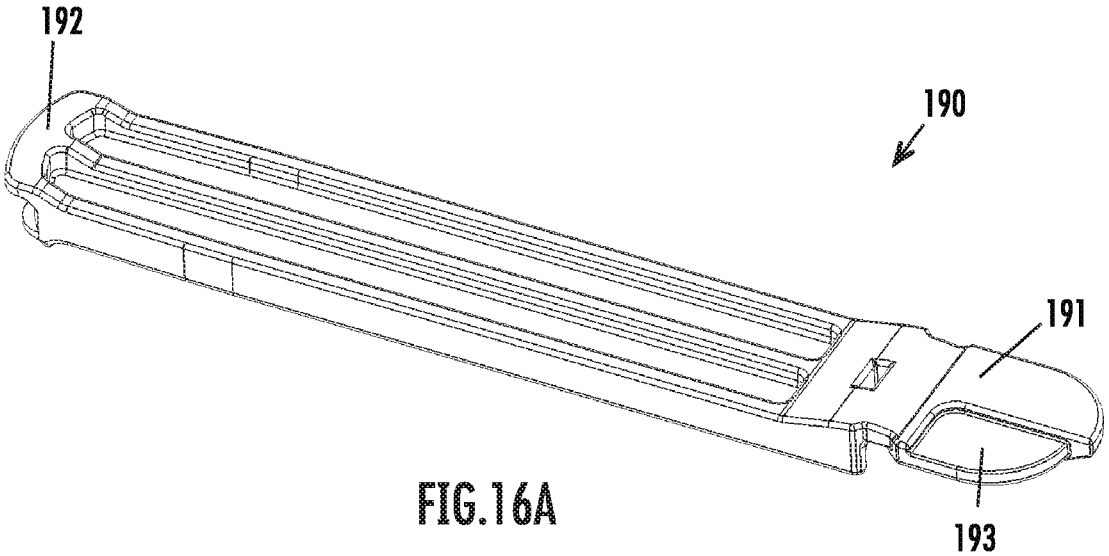
FIGS. 16A and 16B are perspective views of a tool of the loader of FIG. 10.
Figure 16B:
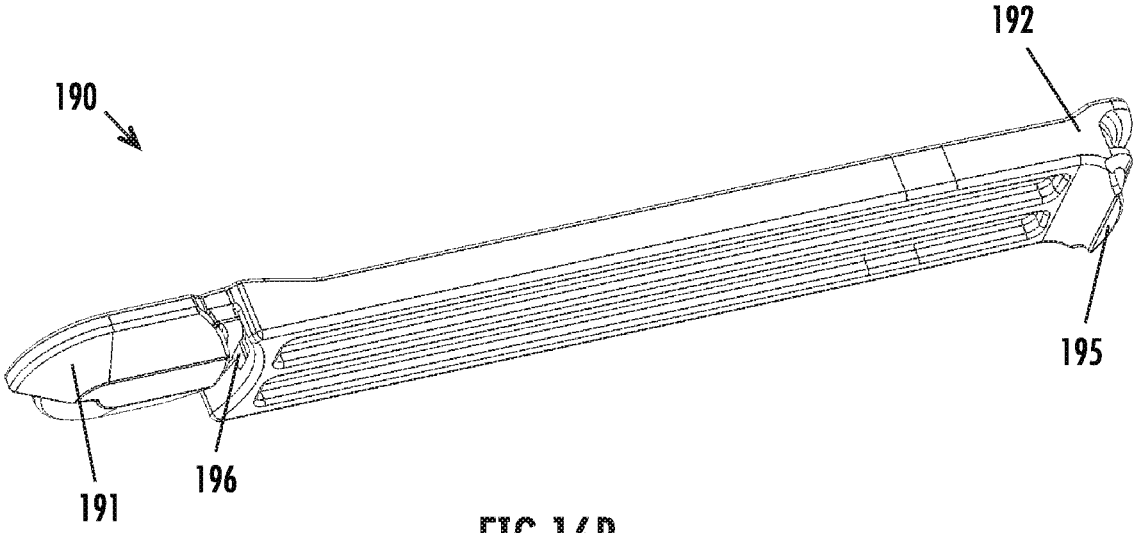

As shown in FIGS. 10, 16A, and 16B, the loader 100 may include a multipurpose tool 190 that includes a first end 191 and a second end 192. The tool 190 has an installed position such that (1) the second end 192 engages an inner edge of the channel 103 at the proximal end 103.1 and (2) protrusion 187 of the ring portion 182 inserts into and engages recess 196. When in the installed position, protrusion 195 extends into a pathway of the cartridges moving through the loader 100. In some embodiments, the protrusion 195 increases perceived resistance felt when pushing the follower 180/ring portion 182 toward the proximal end 102 of the loader 100. The increased resistance occurs because (1) the protrusion 195 and tool 190 must deflect to allow the cartridge to pass and/or (2) the cartridge must move around the protrusion 195 (i.e., toward the top of the loader 100).

Figure 16C:
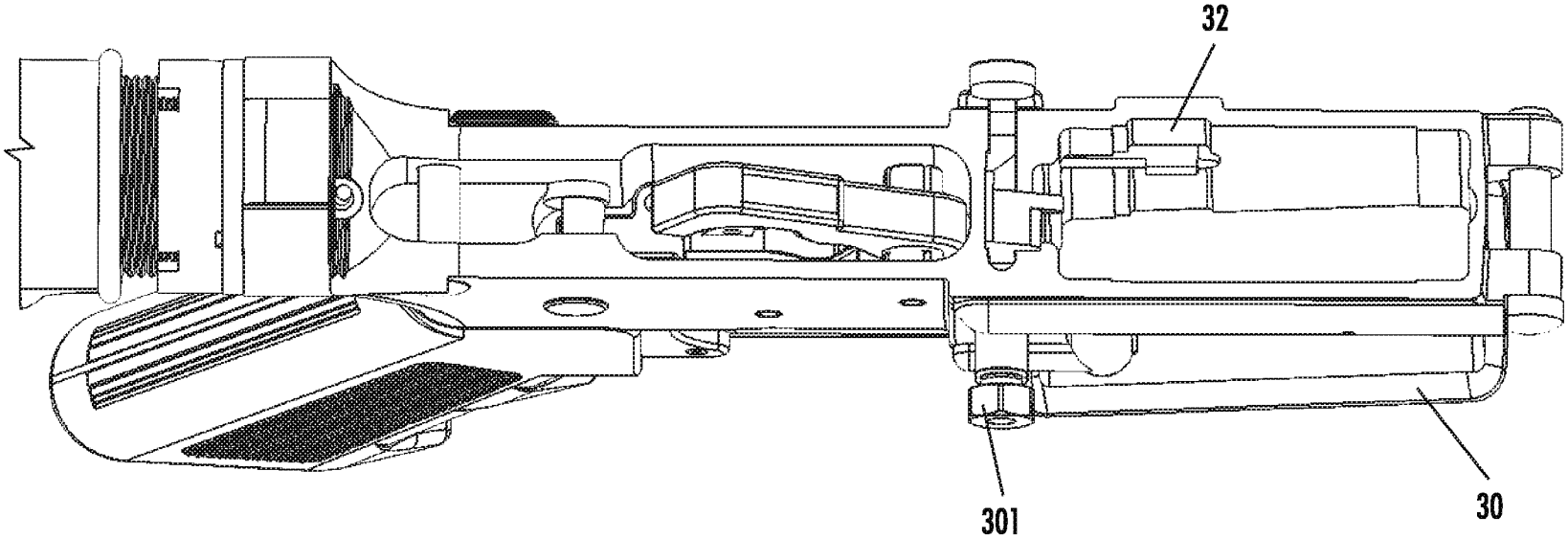
FIG. 16C is a partial top perspective view of the firearm of FIG. 7A.

The multipurpose tool 190 may also be disengaged from the loader 100. After being disengaged, the first end 191 of the tool 190 may be used to perform functions relevant to the magazine 40. As described below, in some embodiments, the magazine release mechanism may be disabled using the lock 301. However, it may be necessary to service or remove the magazine 40. After disengaging the takedown pin and/or the pivot pin so the upper receiver 20 can move or pivot relative to the lower receiver 30, the interior of the lower receiver 30 is exposed as shown in FIG. 16C. The tool 190 may be inserted along interior channel 32 such that the first end 191 of the tool 190 (including recessed area 193) engages the magazine 40 to allow disassembly, removal, and/or detachment of the magazine 40.

Figure 4:
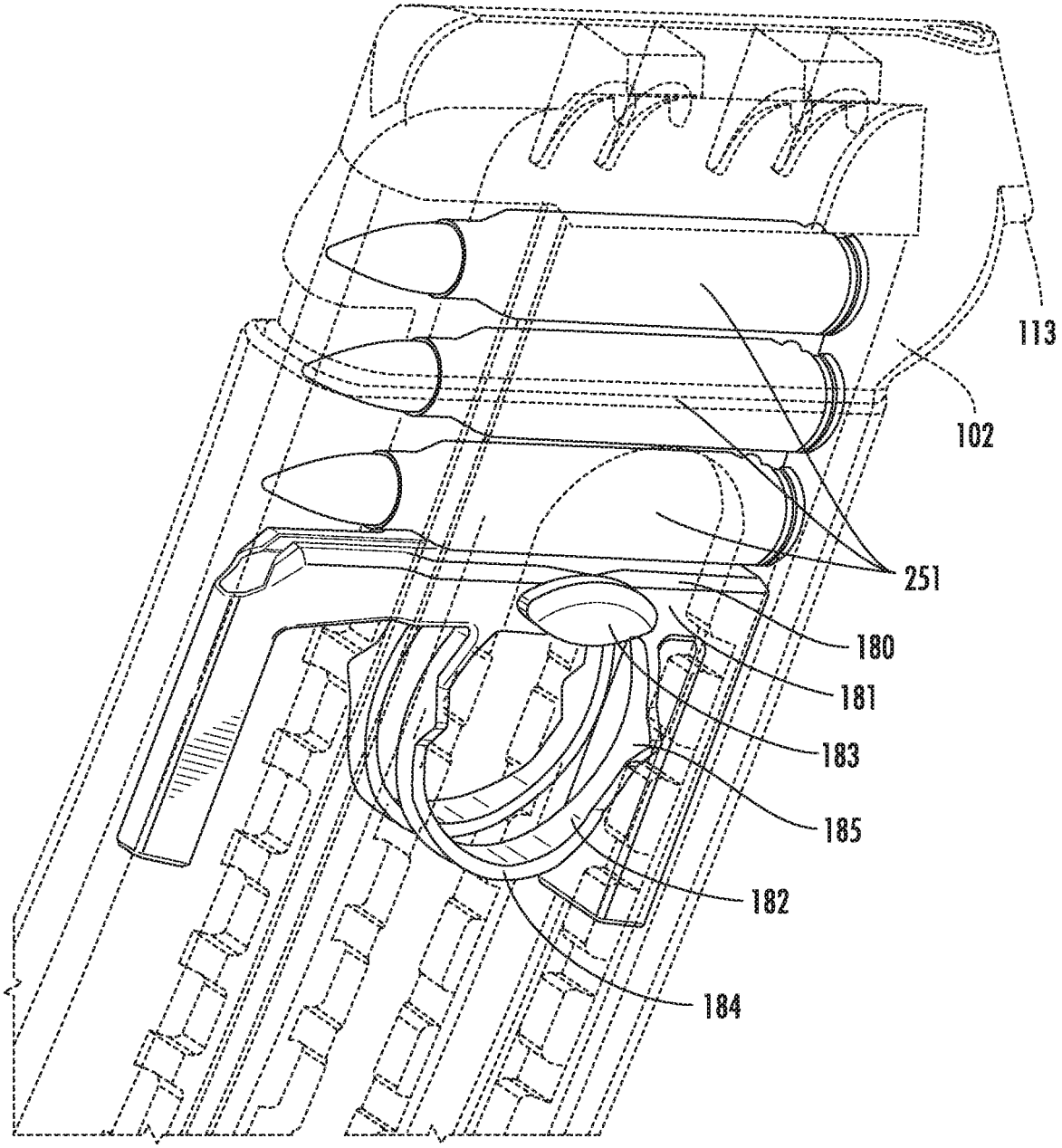
FIG. 4 is a partial perspective view of the loader of FIG. 2.
Figure 5A:
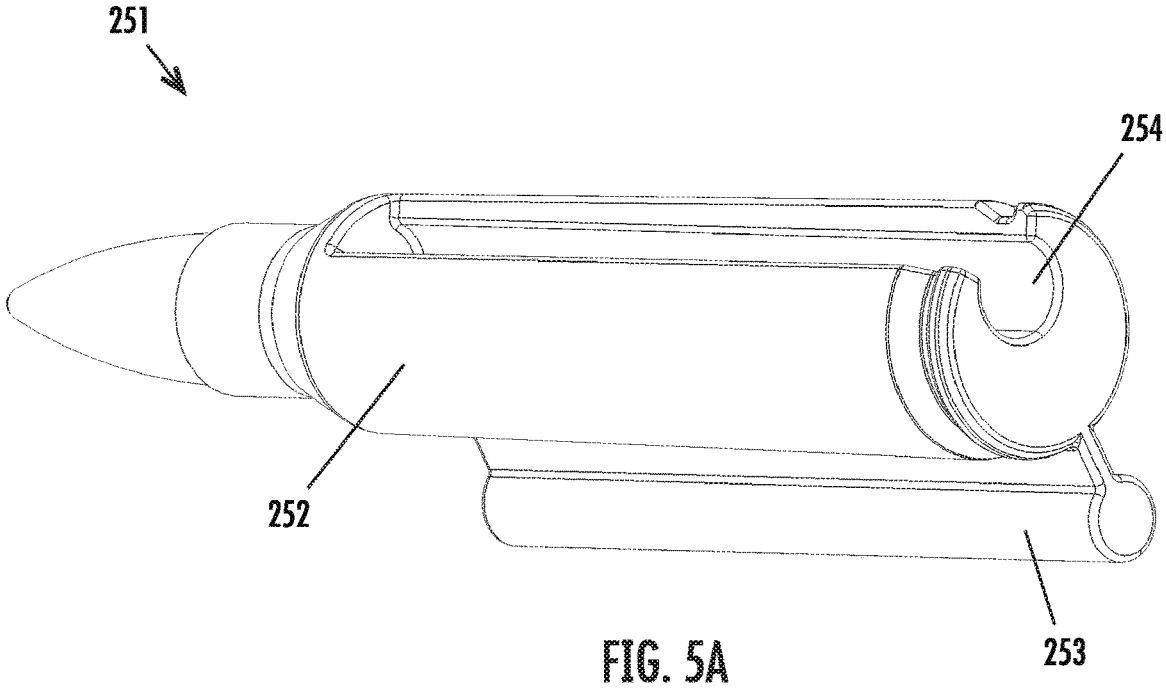
FIGS. 5A and 5B are perspective views of a spacer of the loader of FIG. 2.
Figure 5B:
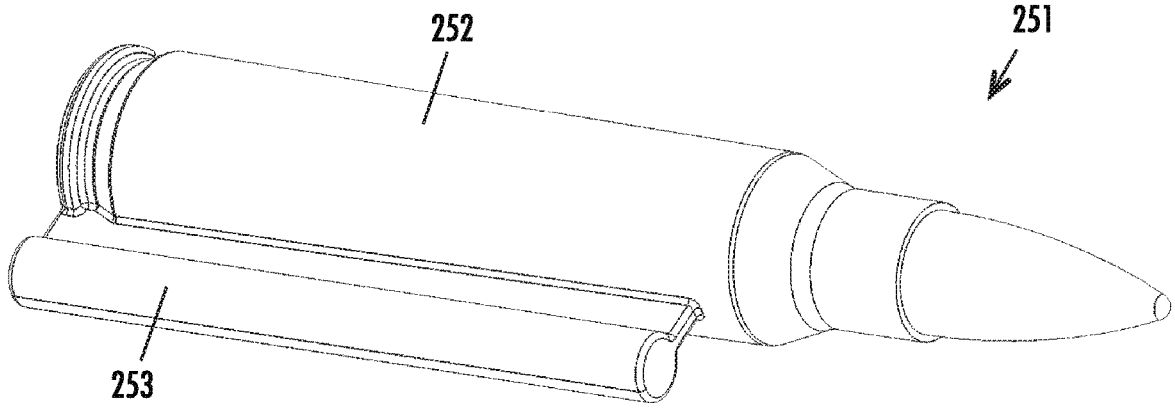

The leading edge of the follower 180 may include a spacer or other object that extends toward the proximal end 102 of the loader 100. The spacer or other object may be an integral part of the follower 180 or may be removable. In some embodiments, the leading edge of the follower 180 may include provisions for attaching a spacer. For example, the follower 180 may include an interface channel 186 (see FIGS. 6A, 6B, and 13B) for attaching one or more removable components, such as spacer 251. As shown in FIGS. 5A and 5B, the spacer 251 includes a main body 252 and may have a shape that approximates a cartridge. The spacer 251 may include a corresponding interface component 253 that engages interface channel 186. Although the spacer 251 is illustrated with a male engagement component (interface component 253) and the follower 180 is illustrated with a female component (interface channel 186), the arrangement may be reversed such that the follower 180 includes a male engagement component and the spacer 251 includes a female engagement component. The interface channel 186 may have an approximately circular cross section and the interface component 253 may include an approximately cylindrical tongue that can be inserted into the interface channel 186. In some embodiments, the circular cross section of the tongue channel allows the spacer 251 to pivot with respect to the follower 180 as it follows the internal contour of the loader 100 or the firearm. As shown in FIG. 5A, the spacer 251 may include an auxiliary channel 254 such that an additional spacer 251 may be attached to the spacer 251. As one example, FIG. 4 shows follower 180 with three attached spacers 251.

Figure 15A:
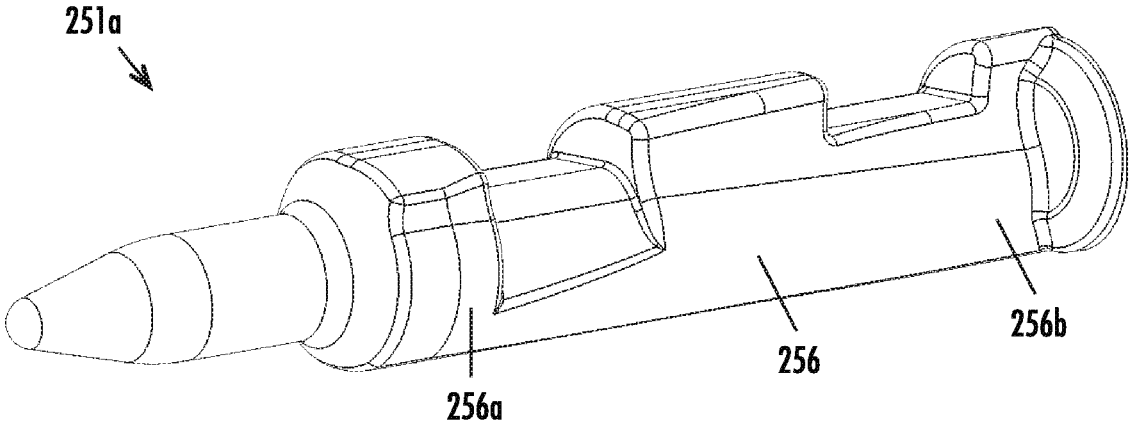
FIGS. 15A and 15B are perspective views of a spacer of the loader of FIG. 10.
Figure 15B:
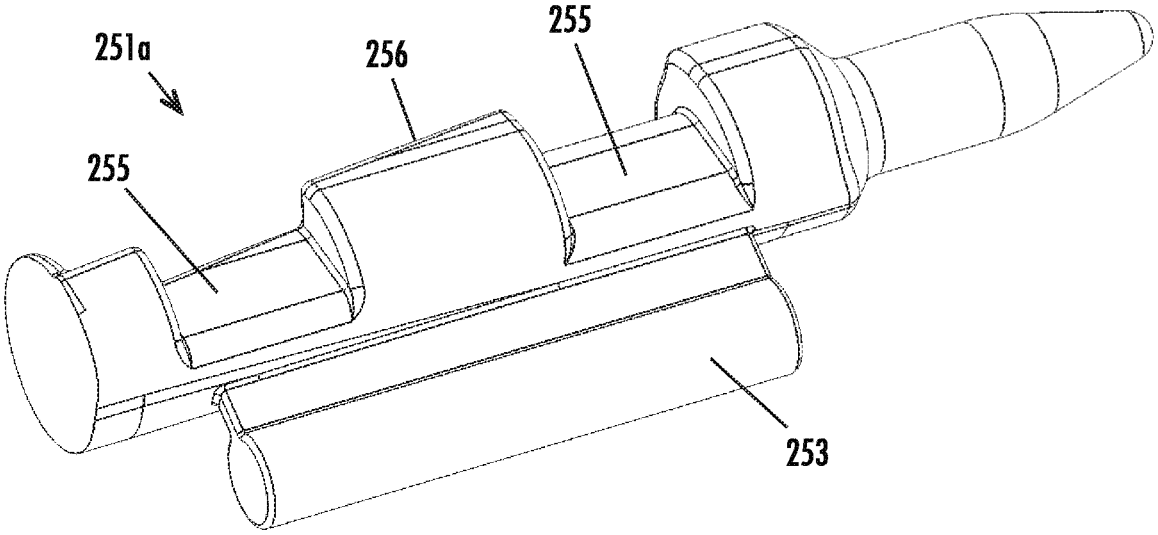

In some embodiments, all of the spacers 251 are identical. However, as shown in FIGS. 12, 13B, 15A, and 15B, at least one of the spacers 251*a* may have a different shape. For example, spacer 251*a* may include at least one channel 255 that correspond or engage the spring(s) 111. The spacer 251*a* may also include an interface surface 256 configured to engage the surface of the last round inserted into the firearm from the loader 100. In some embodiments, the interface surface 256 is curved or angled such that the first end 256*a*, which is closer to the projectile end of a cartridge, protrudes further from the follower 180. In other words, the first end 256*a* of the interface surface 256 protrudes further into the firearm than the second end 256*b*. The second end 256*b* is recessed within the spacer 251*a* and/or is closer to the interface component 253 of the spacer 251*a*. The angle/curvature of the interface surface 256 affects all cartridges moving from the loader 100 into the firearm/magazine. As shown in FIGS. 15A and 15B, spacer 251*a* does not include an auxiliary channel 254. However, in some embodiments, spacer 251*a* may include an auxiliary channel 254 such that multiple spacers 251*a* may be attached to one another and/or to the follower 180. In some embodiments, at least one of the spacers 251 (and/or spacer 251*a*) pivot about interface component 253. For example, when the spacers 251 (and/or spacer 251*a*) are inside the firearm (e.g., through the ejection port), the spacers 251 (and/or spacer 251*a*) pivot such that the spacer(s) point toward the magazine 40, 41 to ensure the cartridges enter the magazine 40, 41. In some embodiments, the spacer 251*a* reaches a top of the magazine 40, 41 (e.g., to or beyond the feed lips of the magazine 40, 41). In some embodiments, when the follower 180 is moved to the proximal end 102, 202 of the loader 100, 200 (i.e., fully inserted), a portion of the spacer 251*a* is inside the magazine 40, 41.

Figure 7A:
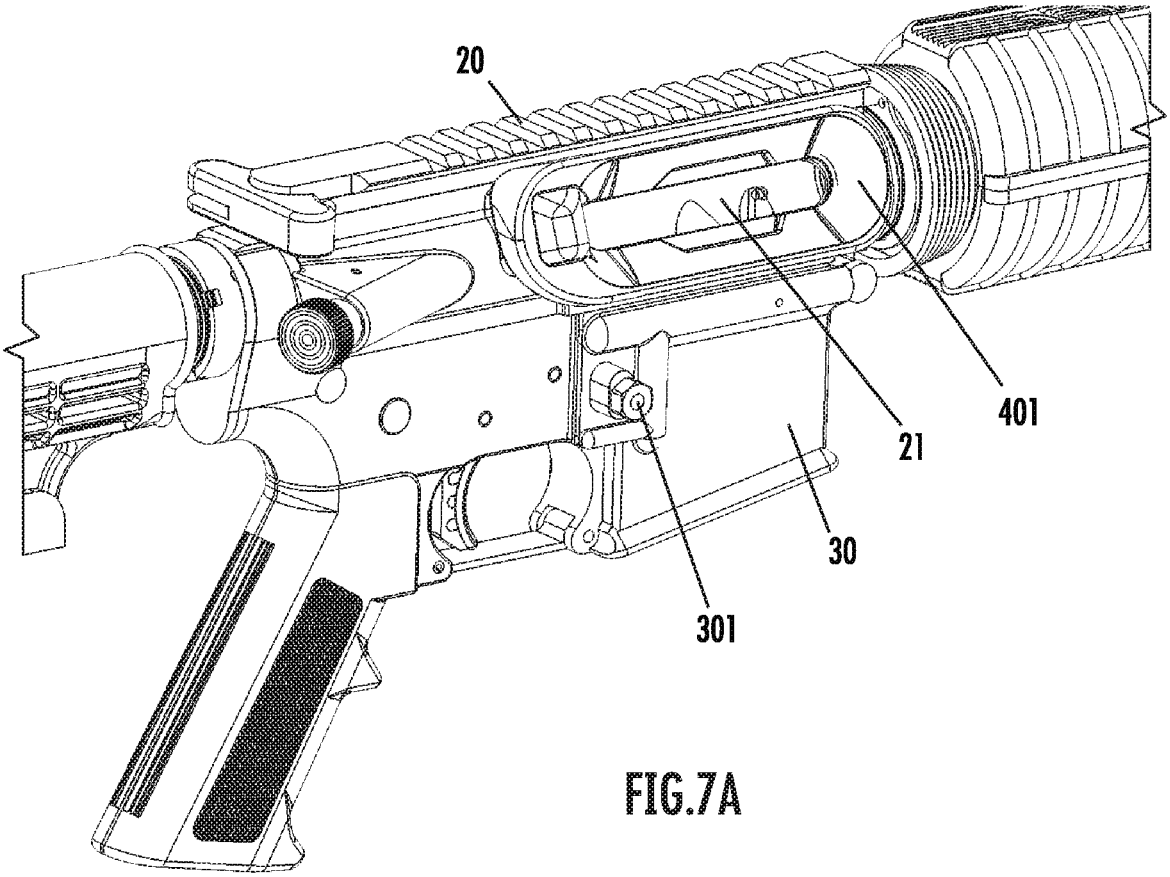
FIG. 7A is a rear right partial perspective view of a firearm, according to certain embodiments of the present invention.
Figure 7B:
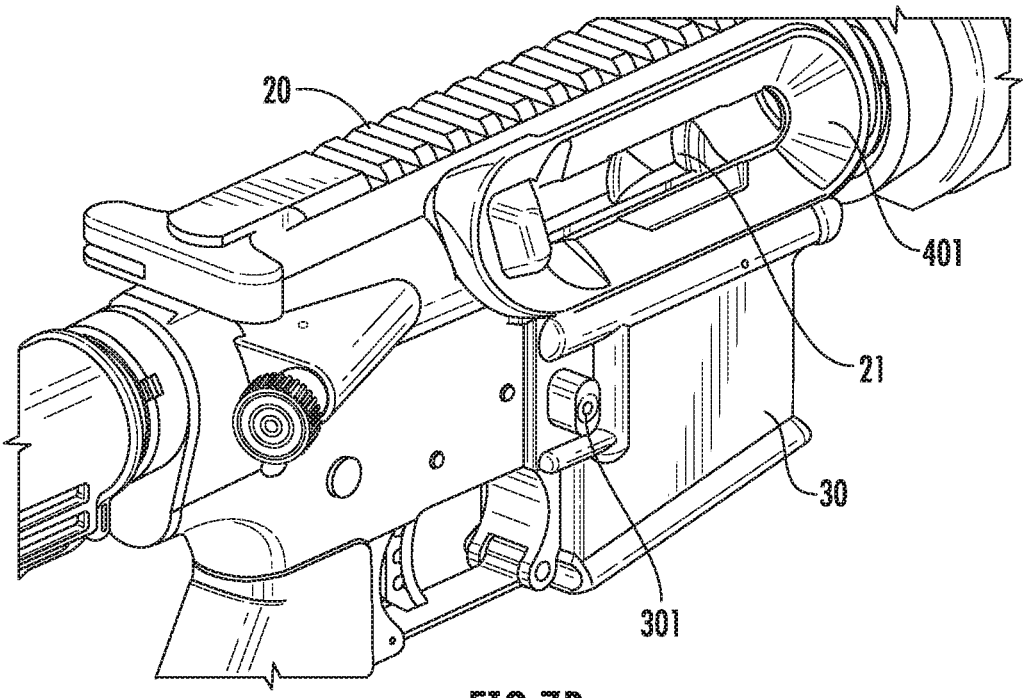
FIG. 7B is a rear right partial perspective view of the firearm of FIG. 7A.
Figure 8A:
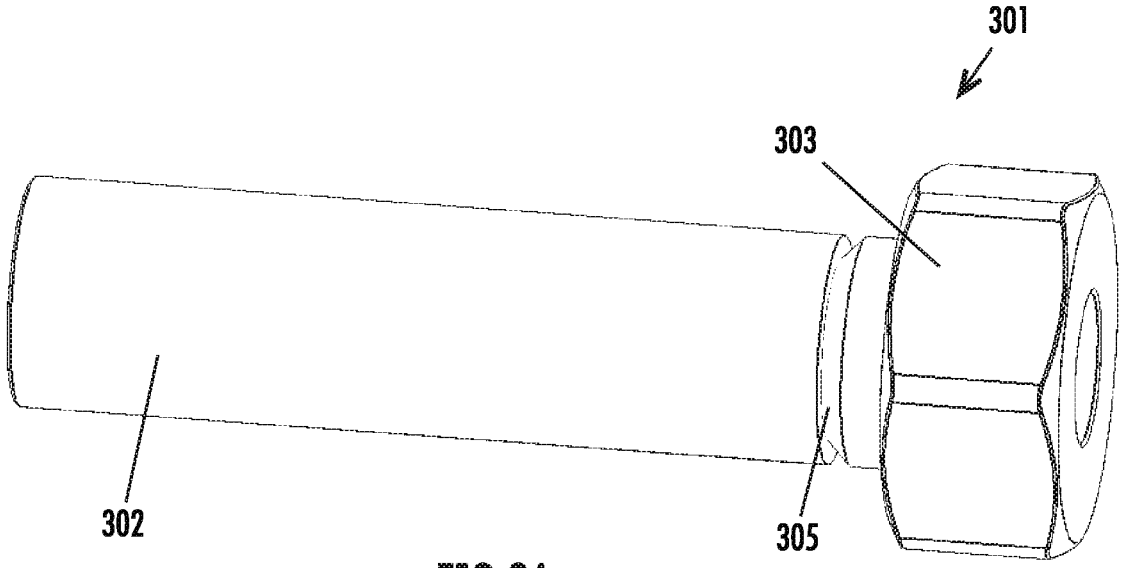
FIG. 8A is a perspective view of a lock of the firearm of FIG. 7A.
Figure 8B:
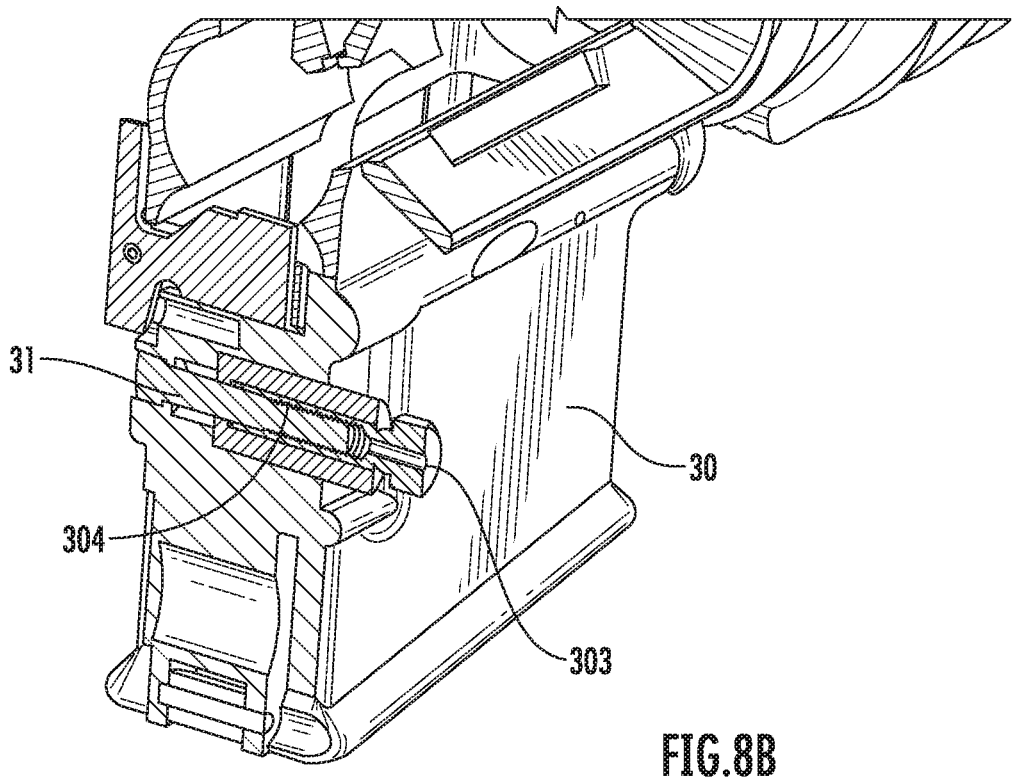
FIG. 8B is a cross section view of a lock of the firearm of FIG. 7A.

In some embodiments, the magazine 40 is fixed to the firearm using a lock 301. The lock 301, which is shown in FIGS. 7A-8B and 16C, includes a shaft 302 and a head 303. As shown in FIGS. 8A and 8B, the shaft 302 of the lock 301 includes a hollow portion with internal threads 304 and a necked down region 305. The threads 304 engage the threads of the magazine catch 31 when the lock is inserted into the lower receiver 30 into the typical location of the magazine release button. Once the lock 301 has fully engaged the magazine catch 31, sufficient torque is applied to the head 303 until the shaft 302 breaks at the necked down region 305, which leaves the lock 301 permanently installed within the lower receiver 30 (i.e., the head 303 and a small portion of the shaft 302 are discarded). FIG. 7A shows the lock 301 before the shaft 302 is broken (i.e., head 303 still installed) and FIG. 7B shows the lock 301 after the shaft 302 has broken (i.e., lock 301 is permanently installed).

Figure 9A:
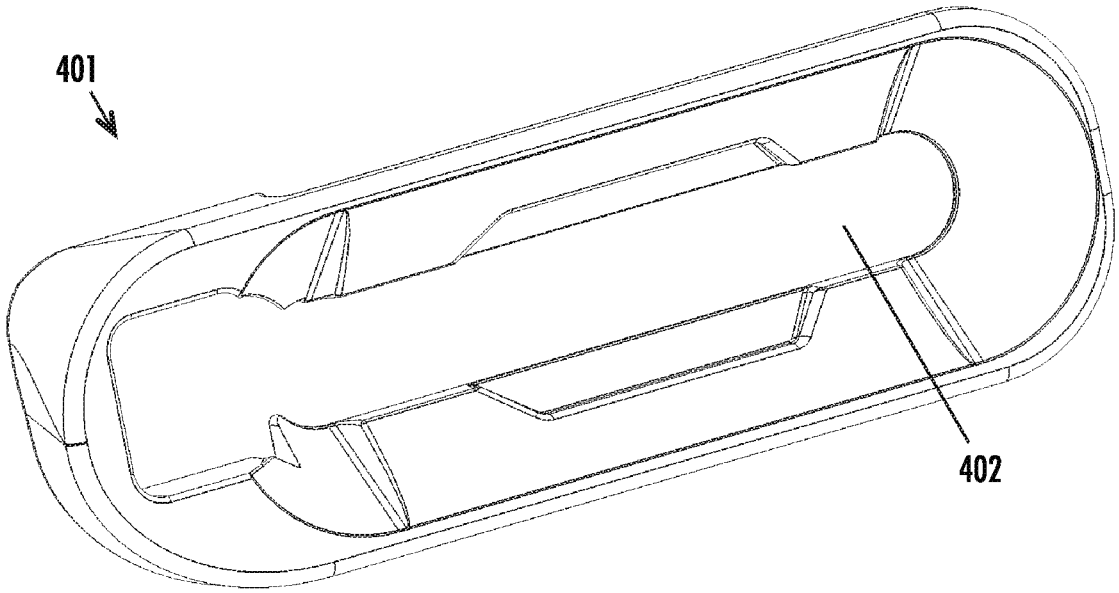
FIG. 9A is a right side perspective view of a lip member of the firearm of FIG. 7A.
Figure 9B:
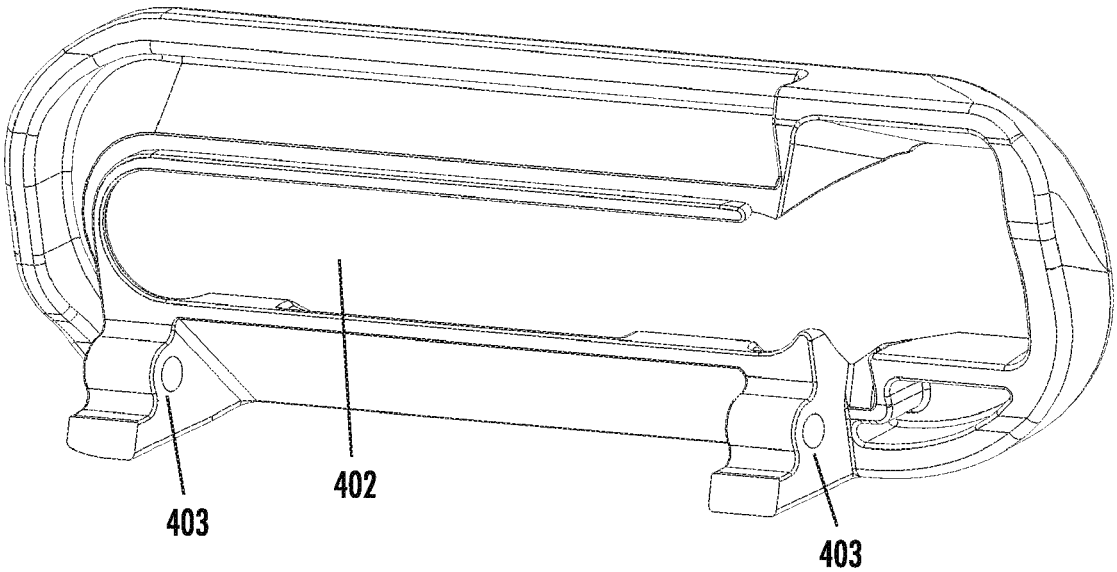
FIG. 9B is a left side perspective view of a lip member of the firearm of FIG. 7A.

To facilitate insertion of the loader 100 into the upper receiver 20, in some embodiments, the firearm may include a lip member 401. As shown in FIGS. 7A and 7B, the lip member 401 may be installed surrounding the ejection port 21 of the upper receiver 20. As shown in FIGS. 9A and 9B, the lip member 401 includes a hole 402 that approximately aligns with the ejection port 21 when the lip member 401 is installed. The lip member 401 may also include two attachment lugs 403 which can be attached to the ejection port cover lugs 22 of the upper receiver 20 (see FIG. 1C). The lip member 401 is optional and not required for using the loader 100 with a firearm. However, in some embodiments, the lip member 401 at least (1) simplifies insertion of the loader 100 into the ejection port 21 and (2) reduces wear and scratches of the loader 100 and the upper receiver 20. The lip member 401 may act as a funnel to help guide the loader 100 into the ejection port 21.

According to certain embodiments of the present invention, as shown in FIGS. 17-21, a loader 200 may interface with a firearm that includes a receiver 35, a dust cover 36, and a magazine 41. Some components of loader 200 may be similar to loader 100. In some embodiments, the loader 200 is inserted into the ejection port (see FIG. 17) of the firearm. The loader 200 facilitates the loading of at least one round of ammunition through the ejection port, through the dust cover 36 and/or the receiver 35 and into the magazine 41. The loader 200 may facilitate loading of 5 rounds, 10 rounds, 20 rounds, 30 rounds, 40 rounds, or any other appropriate number of rounds. In some embodiments, magazine 41 is fixed in position. Although not shown, the loader 200 may include a follower.

Figure 18:
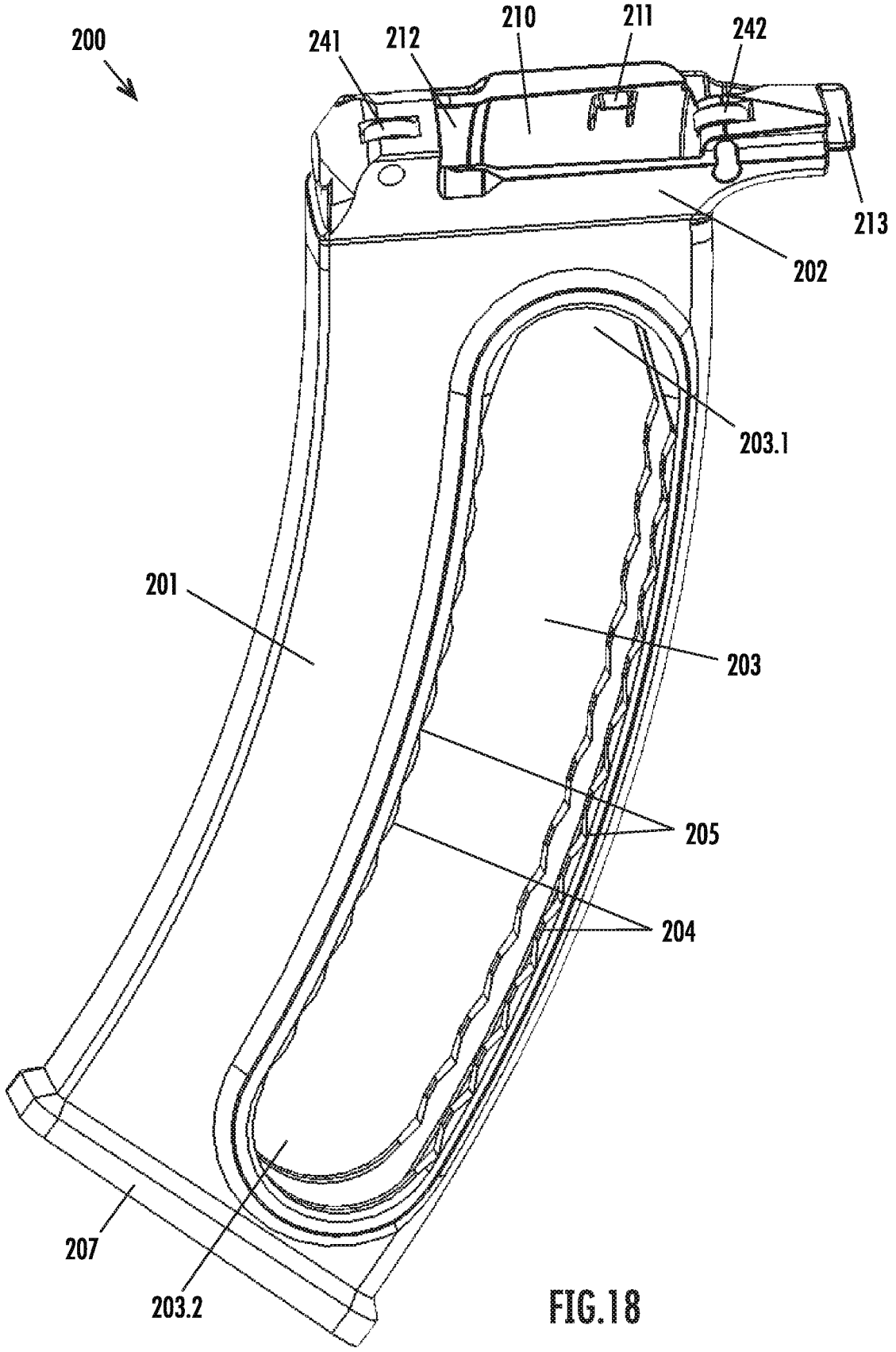
FIG. 18 is a bottom perspective view of a loader, according to certain embodiments of the present invention.
Figure 19:
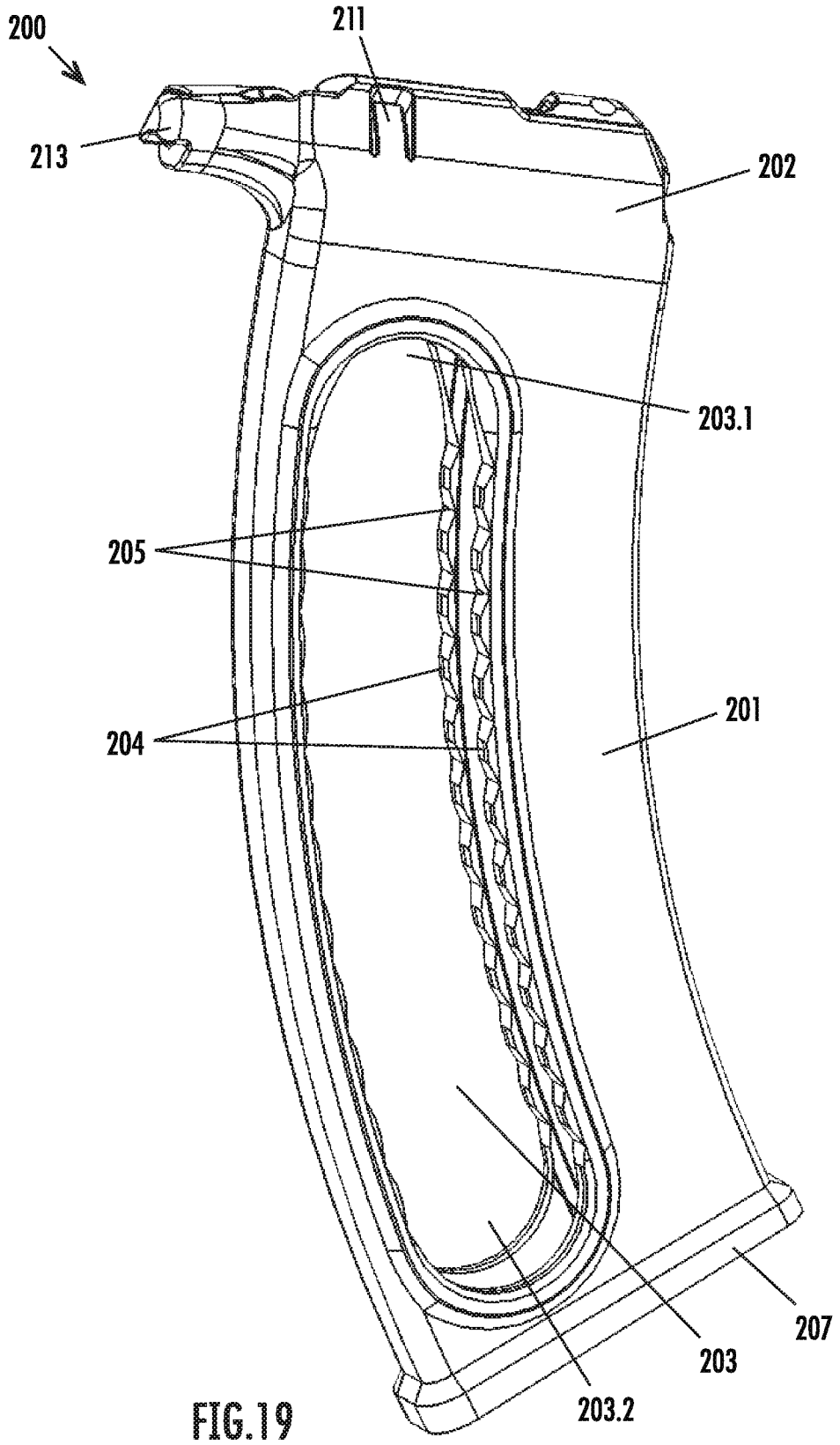
FIG. 19 is a top perspective view of the loader of FIG. 18.

In some embodiments, as shown in FIGS. 18 and 19, the loader 200 includes a main body 201, a proximal end 202, and a distal end 207 where the proximal end 202 may be inserted into the firearm. The main body 201 may include a channel 203 that extends at least partially through the thickness of the main body 201. The channel 203 may extend along at least part of the length of the main body 201.

Figure 20A:
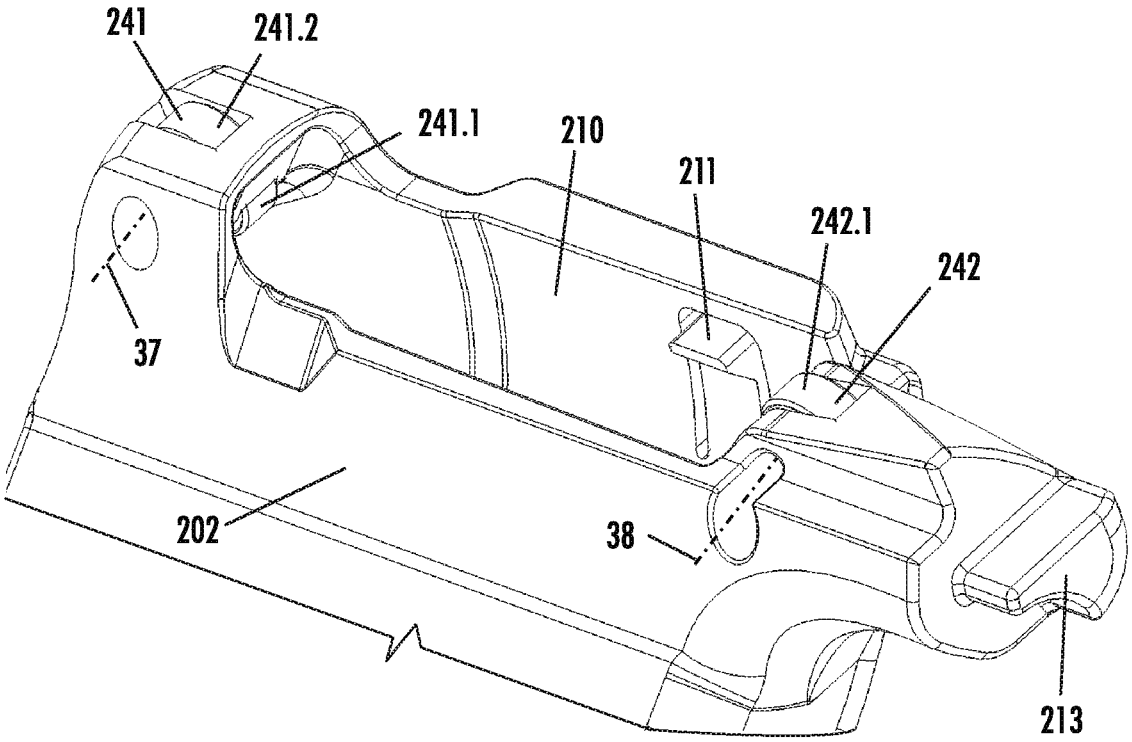
FIGS. 20A and 20B are partial perspective views of a proximal end of the loader of FIG. 18.
Figure 20B:
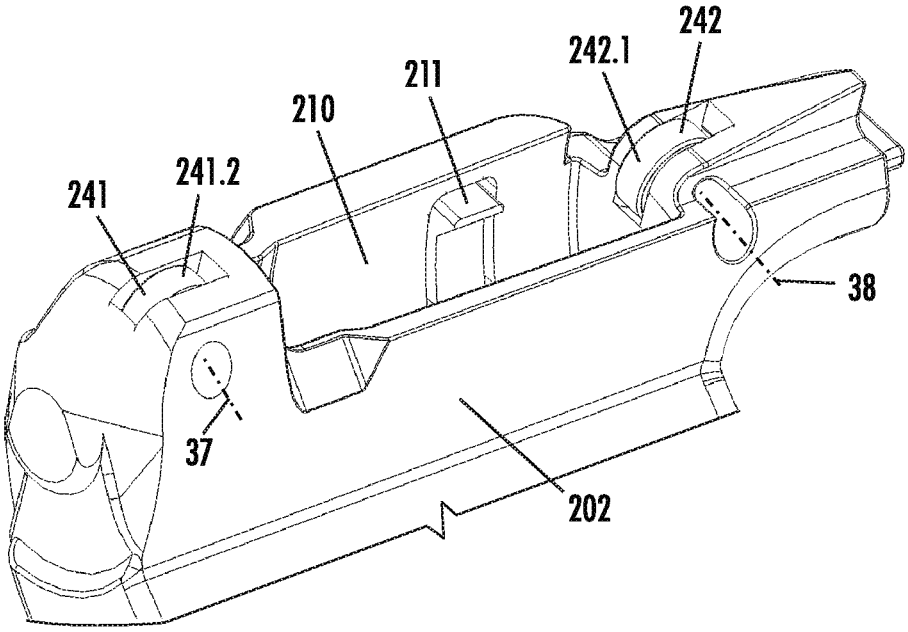

At the proximal end 202, there is an opening 210 to allow cartridges to move from the loader 200 into the firearm (see FIGS. 18, 20A, 20B, and 21). The opening 210 may include at least one spring 211, which prevent cartridges from falling through the opening 210. To insert a cartridge into the loader 200, the cartridge may be pressed into the opening 210 causing the spring(s) 211 to move away from the opening 210. As shown in FIGS. 18, 20A, and 20B, the opening 210 may include a profiled shape including a narrower portion 212 that approximately corresponds to the shape of the projectile end of a cartridge such that cartridges can only be inserted into the loader in one orientation. The spring(s) 211 also prevent cartridge(s) from exiting the loader 200 unless the follower is pushed toward the proximal end 202 (causing the spring(s) 211 to deflect away from the opening 210). In addition, spring(s) 211 guide cartridge(s) into the firearm.

To use the loader 200, the operator of the firearm/loader pushes cartridges into the opening 210 with the projectile end of the cartridge aligned with the narrower portion 212 of the opening 210. As explained above, the cartridge will not pass through the opening 210 unless the operator presses the cartridge to deflect the spring(s) 211 away from the opening 210. When one or more cartridges are inside the loader 200, the cartridges press the follower toward the distal end 203.2 of the opening 230. In some embodiments, cartridges press against a spacer to move the follower away from the opening 210.

Figure 17:
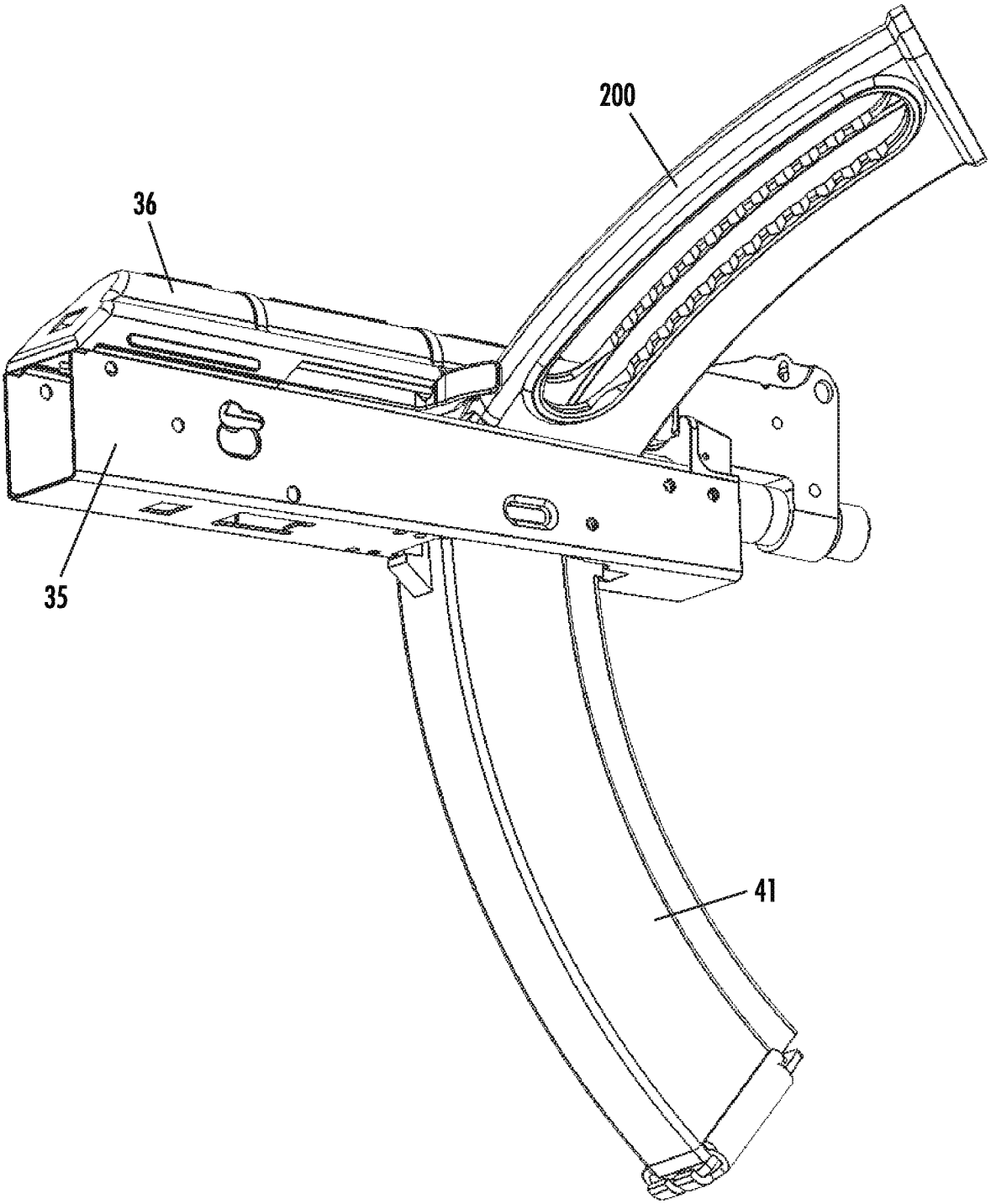
FIG. 17 is an rear right partial perspective view of a firearm, according to certain embodiments of the present invention.
Figure 21:
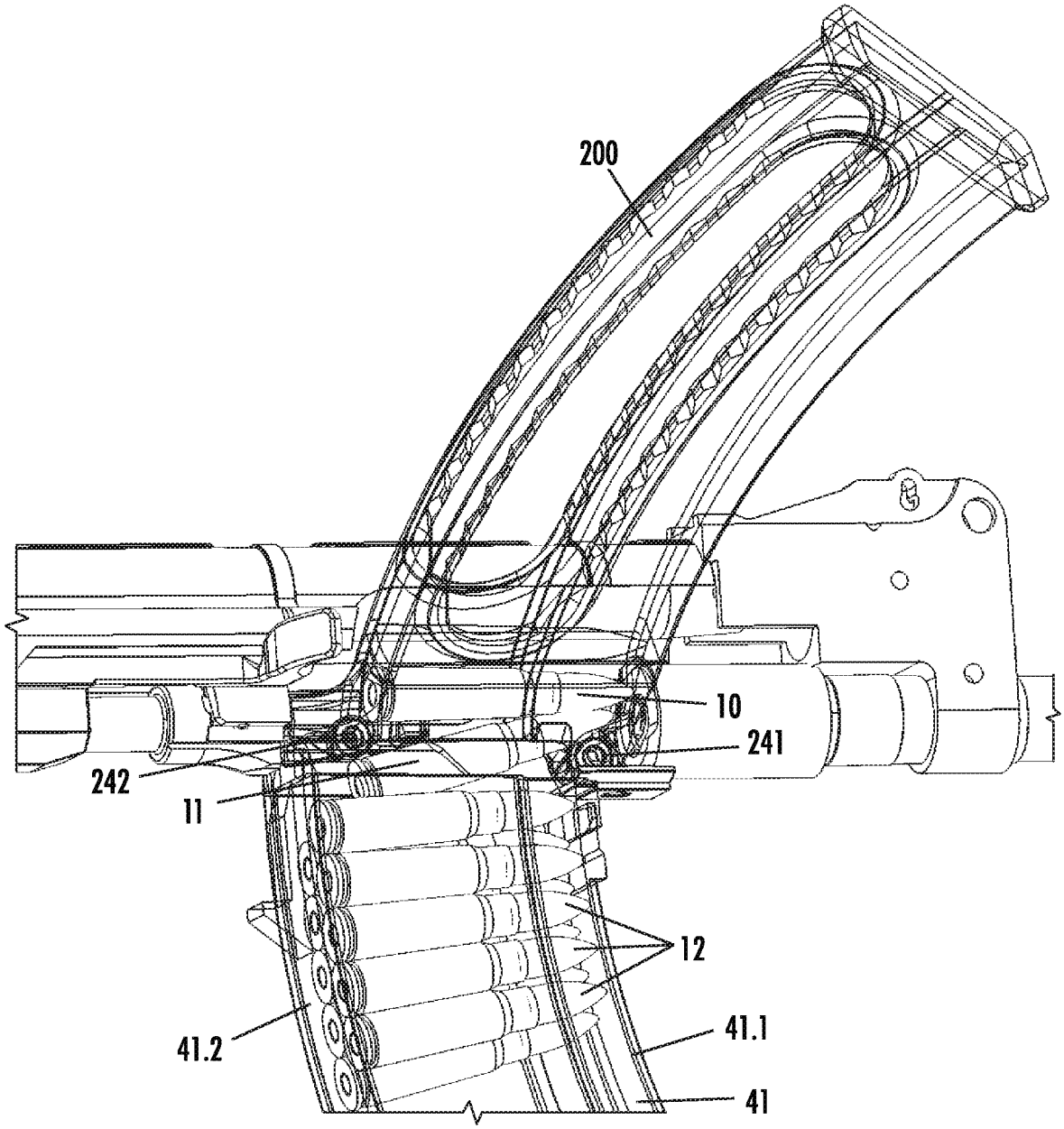
FIG. 21 is a partial perspective view of the loader of FIG. 18 in an engaged configuration.

In some embodiments, the loader 200 has an engaged configuration. For example, when the loader 200 is inserted into the firearm (as shown in FIGS. 17 and 21), the opening 210 faces downward approximately toward the magazine 41. To insert the loader 200 into the firearm, the bolt (not shown) must be held open (e.g., after the last round in the magazine is fired, the bolt is held open) such that the ejection port is open. When the proximal end 202 of the loader 200 is fully inserted into the firearm, the protrusion 213 (on the rear side of the proximal end 202) may engage the face of the bolt. Once the loader 200 is inserted into the ejection port and/or engages the bolt face (using protrusion 213), the operator of the firearm may push the follower toward the proximal end 202 to push cartridges from the loader 200 into the firearm.

As shown in FIGS. 18 and 21, the loader 200 may include at least one cartridge moving portion 241, 242, which may include a roller, wheel, low-friction coating or other component to facilitate movement of cartridges. As one example, a forward roller 241 and/or a rear roller 242 facilitates movement of cartridges from the loader 200 into the firearm. The forward and rear rollers 241, 242 may have a toroid shape, a sphere shape, a cylinder shape, or any other appropriate shape. In some embodiments, the loader 200 does not include any rollers and, in some cases, may include a smooth surface and/or a low friction portion at the illustrated location of at least one of the forward and rear rollers 241, 242. FIG. 21 shows the loader 200 and part of the firearm (including magazine 41) as transparent to illustrate the function of the loader 200. Cartridge 10 is located within the loader 200, cartridge 11 is partially inserted into the firearm, and cartridges 12 are located within magazine 41. When a cartridge approaches opening 210, the forward end of the cartridge contacts the interior exposed portion 241.1 of the forward roller 241 such that the rear end of the cartridge enters the firearm (see cartridge 11). When exiting the loader 200, the cartridge is offset relative to the magazine 41 such that the forward end of cartridge 11 is forward of the forward wall 41.1 of the magazine 41. Once the rear end of cartridge 11 contacts the magazine follower (not shown) or a previously inserted cartridge 12, the cartridge 11 slides rearward along forward roller 241 until the cartridge exits the loader 200 and the rear end of the cartridge approaches the rear wall 41.2 of the magazine 41 (see cartridges 12). In addition, the cartridge moves rearward such that the forward end of the cartridge is located rearward of the forward wall 41.1 of the magazine 41 such that cartridge 12 can be fully inserted into magazine 41.

Figure 22A:
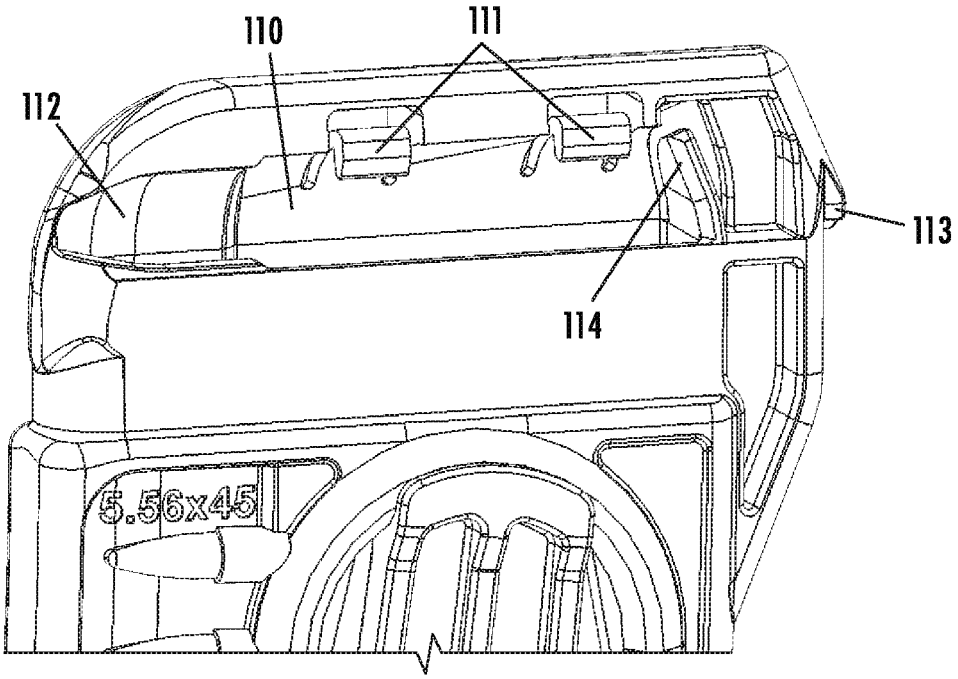
FIGS. 22A and 22B are partial perspective views of the loader of FIG. 10.
Figure 22B:
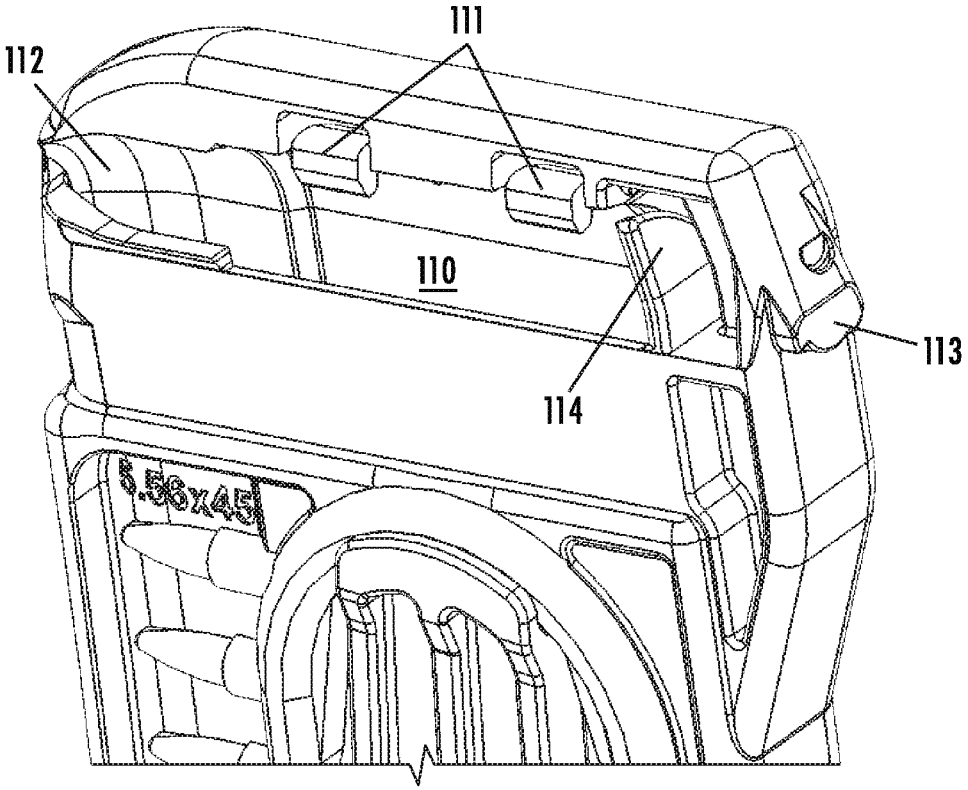

As shown in FIGS. 22A and 22B, the loader 100 may include a flexible member 114. In some embodiments, the loader 100 (or loader 200) may include a flexible member 114 located adjacent to a longitudinal end of the opening 110 (or opening 210). The flexible member 114 is illustrated adjacent to the rear longitudinal end such that the flexible member 114 would be adjacent to a rear end of a cartridge exiting the opening 110 (or opening 210) of the loader. The flexible member 114 may act as a spring that pushes (and/or deflects) such that each cartridge can move an appropriate distance forward/aft when exiting the loader. The movement of the flexible member 114 may compensate for variations in internal geometry of various firearms/magazines. In some cases, the flexible member 114 accommodates or compensates for cartridges with various lengths (i.e., due to manufacturing tolerances, different grain count, etc.). In addition, because the flexible member 114 extends toward the interior of the loader (e.g., toward the interior of opening 110), once a cartridge exits the loader 100 (or loader 200), the flexible member 114 may prevent a cartridge from moving from the firearm back into the loader (i.e., the flexible member 114 may act as a check valve or a one-way valve). Although not shown in FIGS. 22A and 22B, the flexible member 114 may a hinge and/or may interface a separate spring member.

The components of any of the firearms described herein may be formed of materials including, but not limited to, thermoplastic, carbon composite, plastic, nylon, steel, aluminum, stainless steel, high strength aluminum alloy, other plastic or polymer materials, other metallic materials, other composite materials, or other similar materials. Moreover, the components of the firearms may be attached to one another via suitable fasteners, which include, but are not limited to, screws, bolts, rivets, welds, co-molding, injection molding, or other mechanical or chemical fasteners.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A firearm loader for transferring at least one cartridge to a firearm comprising:

a main body comprising a proximal end and a distal end; and a follower disposed inside the main body, wherein:

the firearm loader comprises an engaged configuration wherein the firearm loader is at least partially inserted into a firearm;

the proximal end comprises an opening;

in the engaged configuration, the opening approximately faces a magazine of the firearm; and the opening faces a direction that is non-parallel with a length of the main body.

2. The firearm loader of claim 1, wherein, in the engaged configuration, the firearm loader is at least partially inserted into an ejection port of the firearm.

3. The firearm loader of claim 1, further comprising at least one spring disposed adjacent to the opening, wherein the at least one spring restricts movement of the at least one cartridge through the opening.

4. The firearm loader of claim 1, wherein:

the main body comprises a channel that extends along at least part of the length of the main body; and the follower can be manipulated through the channel.

5. The firearm loader of claim 4, further comprising at least one indexing portion connected to the follower, wherein at least one edge of the channel comprises a series of protrusions and recesses, such that the at least one indexing portion engages the recesses to hold the follower in a given position.

6. The firearm loader of claim 4, wherein the channel comprises an opening through at least a portion of a wide side of the main body.

7. The firearm loader of claim 1, wherein the follower comprises a ring portion that can be manipulated through a channel in the main body to move the follower.

8. The firearm loader of claim 7, wherein the ring portion comprises at least one indexing portion that interfaces with at least one locating feature of the main body.

9. The firearm loader of claim 8, wherein the at least one indexing portion extends from at least one of an axial direction and a circumferential direction of the ring portion.

10. The firearm loader of claim 1, wherein the proximal end comprises a protrusion and, in the engaged configuration, the protrusion engages an interior feature of the firearm.

11. The firearm loader of claim 10, wherein the interior feature comprises a bolt of the firearm.

12. The firearm loader of claim 1, further comprising at least one flexible member disposed adjacent to a longitudinal end of the opening.

13. The firearm loader of claim 1, wherein the follower comprises at least one spacer attached to a leading edge of the follower.

14. The firearm loader of claim 1, further comprising at least one cartridge moving portion adjacent to the opening.

15. A firearm loader that holds a plurality of cartridges comprising:

a main body comprising a proximal end and a distal end;

an opening at the proximal end of the main body;

a follower disposed inside the main body such that the follower moves at least part of a distance between the proximal end and the distal end, at least one indexing portion connected to the follower;

an engaged configuration where the firearm loader is at least partially inserted into an ejection port of a firearm; and a disengaged configuration, wherein:

the main body comprises a channel that extends along at least part of a length of the main body;

the follower can be manipulated through the channel; and at least one edge of the channel comprises a series of protrusions and recesses, such that the at least one indexing portion engages the recesses to hold the follower in a given position.

16. The firearm loader of claim 15, further comprising at least one spring disposed adjacent to the opening, wherein the at least one spring restricts movement of at least one of the plurality of cartridges through the opening.

17. The firearm loader of claim 15, wherein the follower comprises a ring portion that can be manipulated through a channel in the main body to move the follower.

18. The firearm loader of claim 15, further comprising at least one flexible member disposed adjacent to a longitudinal end of the opening.

19. A firearm loader for transferring at least one cartridge to a firearm comprising:

a main body comprising a proximal end and a distal end; and a follower disposed inside the main body, wherein:

the firearm loader comprises an engaged configuration wherein the firearm loader is at least partially inserted into a firearm;

the proximal end comprises an opening; and the opening faces a direction that is not aligned with a length of the main body such that the at least one cartridge exits the firearm loader in a direction that is non-parallel with the length of the main body.

20. The firearm loader of claim 19, wherein the channel comprises an opening through at least a portion of a wide side of the main body.

* * * * *